US011485131B2

(12) United States Patent
Ziegenbalg et al.

(10) Patent No.: US 11,485,131 B2
(45) Date of Patent: Nov. 1, 2022

(54) MACHINE ARRANGEMENT WITH PRINTING UNIT FOR THE SEQUENTIAL PROCESSING OF SHEET-TYPE SUBSTRATES

(71) Applicant: KOENIG & BAUER AG, Würzburg (DE)

(72) Inventors: Christian Ziegenbalg, Weinböhla (DE); Uwe Becker, Radebeul (DE); Ulrich Köhler, Radebeul (DE); Frank Schumann, Friedewald (DE); Carsten Reinsch, Radebeul (DE); Michael Koch, Dresden-Cossebaude (DE)

(73) Assignee: KOENIG & BAUER AG, Würzburg (DE)

( * ) Notice: Subject to any disclaimer, the term of this patent is extended or adjusted under 35 U.S.C. 154(b) by 38 days.

(21) Appl. No.: 17/216,772

(22) Filed: Mar. 30, 2021

(65) Prior Publication Data

US 2021/0213727 A1 Jul. 15, 2021

Related U.S. Application Data

(63) Continuation of application No. 16/660,865, filed on Oct. 23, 2019, now Pat. No. 10,987,917, which is a (Continued)

(30) Foreign Application Priority Data

Aug. 10, 2016 (DE) ..... 10 2016 214 903.2
Mar. 7, 2017 (DE) ..... 10 2017 203 700.8

(51) Int. Cl.
*B41F 19/00* (2006.01)
*B41F 21/10* (2006.01)
(Continued)

(52) U.S. Cl.
CPC ..... *B41F 19/007* (2013.01); *B41F 19/001* (2013.01); *B41F 19/008* (2013.01);
(Continued)

(58) Field of Classification Search
CPC .... B41F 19/007; B41F 19/001; B41F 19/008; B41F 21/102; B41F 23/0443; B41F 23/08;
(Continued)

(56) References Cited

U.S. PATENT DOCUMENTS 7,909,454 B2 * 3/2011 Koto ..... B41J 13/223 101/118
9,440,427 B2 9/2016 Schmidt
(Continued)

FOREIGN PATENT DOCUMENTS

DE 20006513 U1 8/2000
DE 19957230 A1 5/2001
(Continued)

OTHER PUBLICATIONS

Reconsideration Report before Appeal in Japanese Application No. 2019-182078 dated Feb. 24, 2022.
(Continued)

*Primary Examiner* — Bradley W Thies
(74) *Attorney, Agent, or Firm* — Mattingly & Malur, PC

(57) ABSTRACT

A machine arrangement sequentially processes sheet-like substrates with multiple different processing stations each having a substrate-guiding unit and a substrate-processing unit. At least one of the processing stations has, as a substrate-processing unit, at least one non-impact printing device which prints on the substrate. The processing station with the at least one non-impact printing device has a printing cylinder. Each non-impact printing device is arranged at the circumference of the printing cylinder. The
(Continued)

printing cylinder is triple-sized or quadruple-sized. A double-sized or a triple-sized transfer drum, or a corresponding feed cylinder, is arranged directly upstream of this printing cylinder. Alternatively, a double-sized or a triple-sized transfer drum, or a corresponding transfer cylinder, is arranged directly downstream of this printing cylinder.

18 Claims, 19 Drawing Sheets

Related U.S. Application Data continuation of application No. 16/318,161, filed as application No. PCT/EP2017/068774 on Jul. 25, 2017, now Pat. No. 10,493,746.

(51) Int. Cl.

| | |
|---|---|
| ***B41F 23/04*** | (2006.01) |
| ***B41F 25/00*** | (2006.01) |
| ***B41J 13/22*** | (2006.01) |
| ***B41F 23/08*** | (2006.01) |

(52) U.S. Cl.
CPC ..... *B41F 21/102* (2013.01); *B41F 23/0443* (2013.01); *B41F 23/08* (2013.01); *B41F 25/00* (2013.01); *B41J 13/223* (2013.01); *B41J 13/226* (2013.01)

(58) Field of Classification Search
CPC ..... B41F 25/00; B41F 19/00; B41J 13/223; B41J 13/226; B41J 3/546; B41J 11/0015; B41J 11/002
See application file for complete search history.

(56) References Cited

U.S. PATENT DOCUMENTS

| | | | |
|---|---|---|---|
| 2005/0150408 | A1 | 7/2005 | Hersterman |
| 2016/0023479 | A1 | 1/2016 | Schmidt |

FOREIGN PATENT DOCUMENTS

| | | | |
|---|---|---|---|
| DE | 10312870 | A1 | 2/2004 |
| DE | 102009002580 | A1 | 11/2009 |
| DE | 102009000518 | A1 | 8/2010 |
| DE | 102012218840 | A1 | 5/2013 |
| DE | 102014010904 | B3 | 1/2015 |
| DE | 102015211637 | A1 | 2/2016 |
| EP | 1103375 | A2 | 5/2001 |
| EP | 1 440 351 | B1 | 4/2009 |
| EP | 1440351 | B1 | 4/2009 |
| EP | 2540513 | A1 | 1/2013 |
| EP | 2610064 | A1 | 7/2013 |
| EP | 2752380 | A1 | 7/2014 |
| JP | 3501844 | B2 | 3/2004 |
| JP | 2005-41612 | A | 2/2005 |
| JP | 5068203 | B2 | 11/2012 |
| JP | 5284603 | B2 | 9/2013 |
| JP | 2014234262 | A | 12/2014 |
| JP | 2015063398 | A2 | 4/2015 |
| JP | 3202703 | U | 2/2016 |
| JP | 5911619 | B2 | 4/2016 |
| WO | 2004/013704 | A1 | 2/2004 |

OTHER PUBLICATIONS

International Search Report of PCT/EP2017/068774 dated Nov. 7, 2017.
Japanese Office Action received in corresponding Japanese Application No. 2019-182078 dated Dec. 7, 2020.

* cited by examiner

MACHINE ARRANGEMENT WITH PRINTING UNIT FOR THE SEQUENTIAL PROCESSING OF SHEET-TYPE SUBSTRATES

CROSS REFERENCE TO RELATED APPLICATIONS

This application is a continuation of U.S. patent application Ser. No. 16/660,865, filed Oct. 23, 2019, which is a continuation of U.S. patent application Ser. No. 16/318,161, filed on Jan. 16, 2019, now U.S. Pat. No. 10,493,746, which is the U.S. National Phase, under 35 U.S.C. § 371, of PCT/EP2017/068774, filed Jul. 25, 2017; published as WO 2018/028980 A1 on Feb. 15, 2018, and claiming priority to DE 10 2016 214 903.2, filed Aug. 10, 2016 and to DE 10 2017 203 700.8 filed Mar. 7, 2017, the disclosures of which are expressly incorporated herein by reference in their entireties.

FIELD OF THE INVENTION

The present invention relates to a machine arrangement for the sequential processing of sheet-type substrates. The machine arrangement has multiple different processing stations. These multiple different processing stations each included a substrate guiding unit and a substrate processing unit. At least one of the processing stations has, as a substrate processing unit, at least one non-impact printing unit for printing each of the substrates. That processing station, which has the at least one non-impact printing unit, includes a printing cylinder. The respective non-impact printing unit is arranged on the periphery of the printing cylinder. The respective printing cylinder, in each case, is configured as one of a triple-sized or a quadruple-sized cylinder.

BACKGROUND OF THE INVENTION

WO 2004/013704 A1 describes a digital printing machine for direct, contactless sheet-fed printing, which includes a digital printing couple that is format-free in the circumferential direction and which has a transport device downstream of the digital printing couple, the transport device having grippers for holding sheets on its periphery, and the transport device preferably having a plurality of transport cylinders and/or conveyor belts and/or impression cylinders.

EP 2 540 513 A1 describes a machine arrangement for the sequential processing of multiple sheet-type substrates, each having a front surface and a back surface, said machine arrangement comprising a first printing cylinder and a second printing cylinder, wherein at least one first non-impact printing unit for printing onto the front surface of the relevant substrate and, downstream of the first non-impact printing unit in the direction of rotation of the first printing cylinder, a dryer for drying the front surface of said substrate that has been printed by the first non-impact printing unit, are each located on the periphery of the first printing cylinder, and at least one second non-impact printing unit for printing onto the back surface of the relevant substrate and, downstream of the second non-impact printing unit in the direction of rotation of the second printing cylinder, a dryer for drying the back surface of said substrate that has been printed by the second non-impact printing unit, are each located on the periphery of the second printing cylinder, wherein the first printing cylinder transfers the substrate in question, the front surface of which has been printed and dried, directly to the second printing cylinder.

EP 1 440 351 B1 discloses a digital printing machine for direct, contactless sheet-fed printing, which has a transport device covered with a layer of elastic material on which a printing substrate is transported, the transport device having at least one gripper for holding the sheet on the periphery of the transport device and/or having a stop for positioning the leading edge of the sheet, said digital printing machine also having a digital printing mechanism which is format-variable in the circumferential direction of the transport device, wherein the distance between the highest point on the gripper and/or stop and the surface of the printing substrate to be printed during the printing operation is shorter than the distance between the surface of the printing substrate to be printed and the digital printing mechanism, and the highest point on the gripper and/or stop projects beyond the surface of the transport device that is not covered.

DE 10 2015 211 637 A1 discloses a device for transporting sheets through a printing unit that includes an inkjet printing cylinder and at least one transfer drum, in which each sheet is held on an inkjet printing cylinder and is transferred by a transfer of the leading edge from an upstream transfer drum; a tensioning roller is provided for crease-free positioning of the sheet on the inkjet printing cylinder.

DE 103 12 870 A1 discloses a digital printing machine for sheet-fed printing, having a digital printing mechanism which is format-free in the circumferential direction, an intermediate cylinder located downstream of the digital printing mechanism and coated at least partially with an elastic material, and an impression cylinder located downstream of the intermediate cylinder, wherein the impression cylinder is equipped with grippers for holding the sheet and the intermediate cylinder is provided with recesses on its periphery for receiving the grippers.

DE 10 2014 010 904 B3 discloses a device for the duplex printing of sheet-type printing substrates, in which the printing substrate is guided through more than 360° on an impression cylinder, wherein the active zone of an ink application unit, which has already printed the recto surface of the printing substrate on an impression cylinder upstream, is re-entered by the printing substrate, this time with its verso surface facing the ink application unit, wherein the ink application unit can preferably be pivoted between two impression cylinders arranged one downstream of the other, and wherein the pivotable ink application unit is, e.g. an inkjet print head.

DE 10 2009 000 518 A1 discloses a sheet-fed printing machine having a feed unit for loading sheets to be printed into the sheet-fed printing machine, and having at least one printing element and/or coating unit for printing the sheets with a static print image that is identical for all printed sheets, and having a delivery unit for discharging printed sheets from the sheet-fed printing machine, and having at least one printing unit that does not include a printing forme and that is integrated into the sheet-fed printing machine for printing the sheets, in particular with a dynamic, variable print image, wherein the or each printing unit that includes no printing forme is integrated into the sheet-fed printing machine, where it can be controlled on the basis of process parameters or operating parameters or order parameters or quality parameters.

DE 10 2009 002 580 A1 discloses a printing machine, in particular a sheet-fed offset printing machine, in which a sheet delivery base module is located downstream of a plurality of base modules that are arranged in a row and are each configured as a printing unit or coating unit, wherein the sheet delivery base module includes a printing cylinder that guides the sheet-type material, and an inkjet device for marking the printing substrate is disposed on the periphery of the printing cylinder of the sheet delivery base module.

DE 200 06 513 U1 relates to a sheet-fed rotary printing machine that includes a sheet feed unit, a sheet delivery unit, and a plurality of base modules, which are similar in terms of their basic structure and are arranged between the sheet feed unit and the sheet delivery unit, and which include a sheet guiding cylinder and a sheet conveying means and can be equipped with a printing unit, a coating unit, or a dryer unit; a multifunction module that includes a sheet conveying means and a sheet guiding cylinder is located between the last base module and the sheet delivery unit in the direction of sheet conveyance, and the multifunction module is prepared for the addition of multiple different auxiliary units, the multifunction module being equipped, e.g. for the addition of an inkjet marking unit.

DE 10 2016 207 398 B3, US 2009/0284561 A1, US 2009/0244237 A1, and US 2011/0205321 A1, all subsequently published, each disclose a machine arrangement for the sequential processing of sheet-type substrates, with the machine arrangement in each case including multiple different processing stations; at least one of the processing stations of each machine arrangement includes a non-impact printing unit that prints on each of the substrates, and said processing station which includes the non-impact printing unit has a printing cylinder, with the respective non-impact printing unit being located on the periphery of said printing cylinder.

U.S. Pat. No. 7,909,454 B2 discloses a printing machine for the sequential printing of sheet-type substrates, in which an inkjet printing unit is disposed on the periphery of a printing cylinder and a feed cylinder is located immediately upstream of the printing cylinder, and both the printing cylinder and the feed cylinder are equipped with grippers for holding substrates to be printed.

EP 2 610 064 A1 discloses an inkjet recording apparatus that includes: a) a conveyance device which has a moving suctioning surface for conveying a cut paper medium by suctioning the medium onto the suctioning surface, and suctioning holes that are arranged uniformly in the regions of the suctioning surface; and b) a recording head, which forms an image by ejecting ink by an inkjet method onto a surface of the medium which is conveyed by the conveyance device.

JP 2015 63 398 A discloses an inkjet recording device that includes a transport cylinder configured as a suctioning drum.

EP 2 752 380 A1 discloses a conveying device and image producing device, in which the conveying device comprises a drum having multiple suction fields.

SUMMARY OF THE INVENTION

The object of the present invention is to devise a machine arrangement for the sequential processing of multiple sheet-type substrates.

The object is achieved according to the invention by the provision of the machine arrangement having a double-sized or a triple-sized transfer drum or a corresponding feed cylinder located immediately upstream of the respective printing cylinder. Alternatively, a double-sized or a triple-sized transfer drum or a corresponding transport cylinder is located immediately downstream of the printing cylinder.

The advantages to be achieved with the invention will be clear from the following descriptions.

The solution described here can be used in a hybrid machine arrangement for the processing of sheet-type substrates, preferably in a hybrid printing machine that variably utilizes the high productivity of a conventional printing unit that prints, e.g., by an offset printing method or by a flexographic printing method or by a screen printing method, or the high productivity of a coating unit, in particular a finish coating unit, in combination with at least one non-impact printing unit configured, e.g. as an inkjet printer that prints variable printed images in a flexible manner, wherein both the conventional printing unit or coating unit and the non-impact printing unit are used in an ongoing inline production process, each at its optimum operating speed. A hybrid machine arrangement of this type is highly advantageous in particular for the production of packaging materials, e.g. sheets for the production of folding cartons, because the strengths of each one of the printing units can be utilized, resulting in a flexible and efficient production of the packaging materials. Transporting sheet-type substrates by means of rotary bodies, in particular cylinders and gripper bars or gripper carriages, each of which transfers the sheet-type substrates in a gripper closure to the next subsequent processing station, as is known from sheet-fed offset printing machines, ensures the highest possible register accuracy.

BRIEF DESCRIPTION OF THE DRAWINGS

Exemplary embodiments of the invention are illustrated in the drawings and will be described in greater detail below.

In the drawings.

DESCRIPTION OF THE PREFERRED EMBODIMENTS

Figure 1:
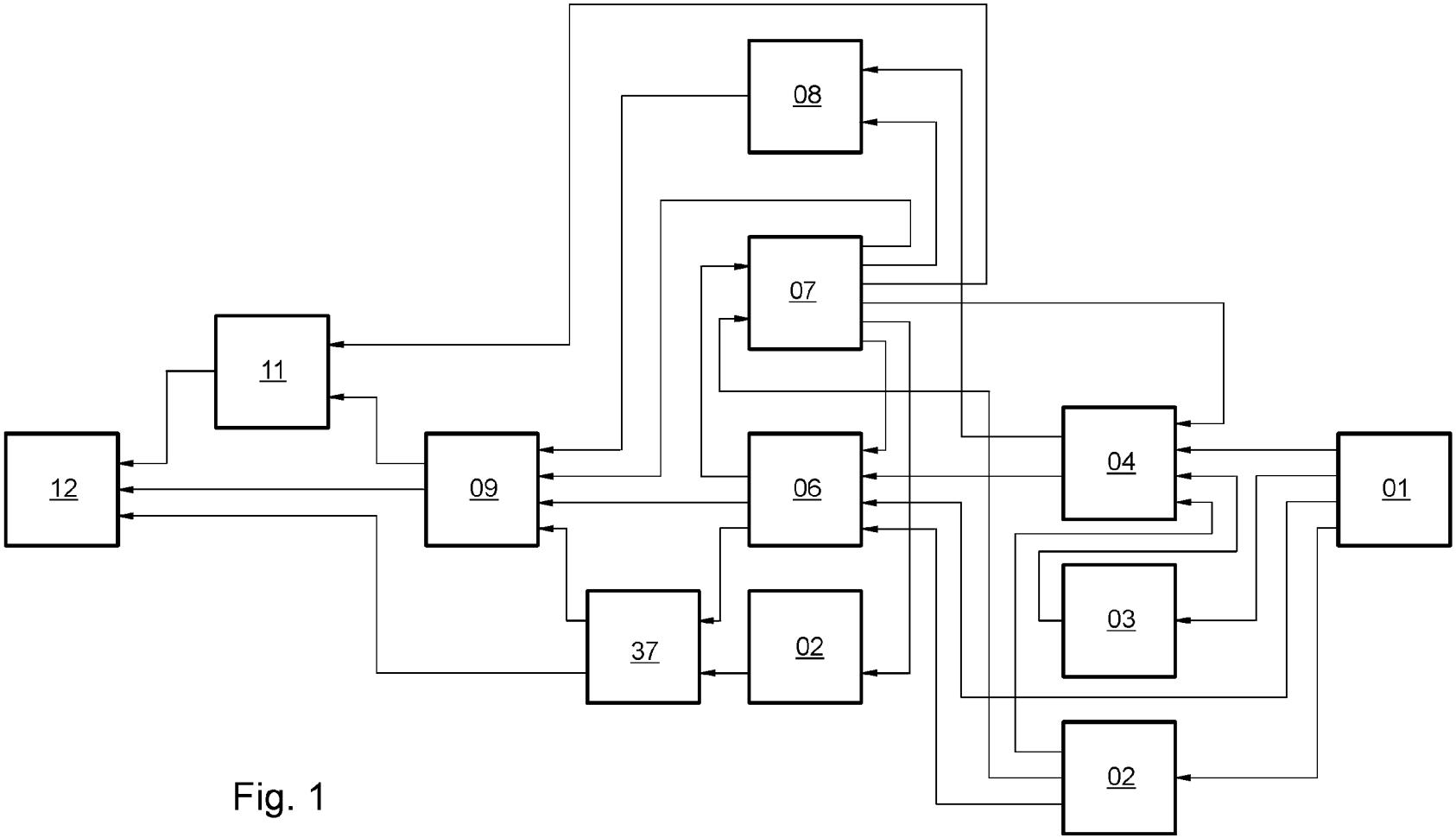
FIG. 1 is a block diagram illustrating the various production lines.

FIG. 1 is a block diagram illustrating various production lines, each of which is or at least can be realized by a machine arrangement that includes multiple, in particular different processing stations 01; 02; 03; 04; 06; 07; 08; 09; 11; 12 for processing at least one sheet-type substrate, in particular a printing substrate, preferably in particular a rectangular printing sheet, referred to simply as a sheet, said at least one substrate being rigid or pliable, depending upon its material, material thickness and/or base weight. In general, multiple sheets, i.e. a sequence of sheets, are processed in succession in a production line during a particular production run, each by the same processing stations 01; 02; 03; 04; 06; 07; 08; 09; 11; 12. Each of these processing stations 01; 02; 03; 04; 06; 07; 08; 09; 11; 12 is preferably configured, e.g. as a functionally independent module, with a module being understood as a machine unit or functional assembly which is typically manufactured separately or is at least mounted separately in its own frame. The modules, which are arranged in a row in the machine arrangement, subdivide said machine arrangement into individual units, with adjacent modules having a substantially vertical joining surface at the point where they are joined. Each of the processing stations 01; 02; 03; 04; 06; 07; 08; 09; 11; 12 located in the respective machine arrangement is thus preferably manufactured separately, and in a preferred embodiment, the functionality of each can be tested, e.g. individually. Each such machine arrangement, which is formed based upon a particular production run by the selection and assembly of at least three different processing stations 01; 02; 03; 04; 06; 07; 08; 09; 11; 12, each configured as a module for processing sheets and for cooperating in the particular production run, makes up a particular production line. Each of the production lines shown, which is embodied by a certain machine arrangement that includes multiple processing stations 01; 02; 03; 04; 06; 07; 08; 09; 11; 12, is configured in particular for producing a packaging material formed from the printing substrate, preferably from the printed sheet. The packaging materials to be produced are, e.g. folding cartons, each of which is fabricated from printed sheets. Thus, the various production lines are configured specifically for the production of different packaging materials. The processing of the printing substrate that is required during a particular production run is carried out inline, i.e., the processing stations 01; 02; 03; 04; 06; 07; 08; 09; 11; 12 that are involved in the particular production run are placed in use one after the other in an ordered sequence and in synchronization with one another as the printing substrate passes through the machine arrangement that is selected for said production run and comprises the respective processing stations 01; 02; 03; 04; 06; 07; 08; 09; 11; 12, without intermediate storage being provided for the printing substrate, i.e., the processed sheets, during the production run carried out by said machine arrangement.

One common feature of all of the production lines shown in FIG. 1 is that each cooperates with a processing station 06, which includes at least one non-impact printing unit 06, preferably multiple non-impact printing units 06, e.g. four, five, six, seven, or more in particular individually controlled printing units, said non-impact printing units 06 preferably being arranged one behind the other in the direction of transport T of the printing substrate and being configured such that each prints or at least is capable of printing onto the printing substrate over at least nearly the entire width thereof oriented transversely to the direction of transport T. A non-impact printing unit 06 uses a printing method without a fixed printing forme and, in principle from one printing to the next, can print the printing substrate, e.g. a sheet that has just been supplied to said printing unit 06, with a print image that is different from the print image that preceded it. Each said non-impact printing unit 06 is embodied in particular as at least one inkjet printer or at least one laser printer. Inkjet printers are dot matrix printers that produce a printed image by the selective ejection or deflection of small droplets of ink; inkjet printers are configured either as continuous inkjet (CIJ) devices or as devices that eject individual ink droplets (drop on demand=DOD). Laser printers produce the respective printed image through an electrophotographic process. A machine arrangement for processing a printing substrate with at least one non-impact printing unit 06 is also called, e.g. a digital printing machine.

In the following, it will be assumed by way of example that a sequence of rigid sheets, in particular, e.g. sheets of a paper, a single-ply or multi-ply paperboard, or a cardboard, as the printing substrate is processed in each case in the respective machine arrangement that includes multiple processing stations 01; 02; 03; 04; 06; 07; 08; 09; 11; 12, in particular to produce a packaging material. Paper, paperboard, and cardboard as printing substrates differ from one another in terms of their respective basis weight, referred to as grammage, i.e. the weight in grams of one square meter of printing substrate. In general, the aforementioned printing substrate having a basis weight of between 7 $g/m^2$ and 150 $g/m^2$ is classified as paper, substrate with a basis weight of between 150 $g/m^2$ and 600 $g/m^2$ is classified as paperboard, and substrate with a basis weight of greater than 600 $g/m^2$ is classified as cardboard. Paperboards and cardboards in particular are used for producing folding cartons, as these materials are readily printable and are suitable for subsequent finishing or processing, such as coating and punching. In terms of fiber content, such paperboards and cardboards may, e.g. be wood pulp-free, low wood pulp-based, or wood pulp-based, or may contain recycled paper. In terms of structure, multi-ply paperboards and cardboards, e.g. corrugated cardboard, each have a top layer, an inlay, and forming the reverse side, a bottom layer. In terms of surface finish, paperboards and cardboards may be uncoated, pigmented, coated, or cast-coated, for example. The sheet format may range, e.g. from 340 mm×480 mm to 740 mm×1060 mm, with the first number in the format specification typically indicating the length of the sheets in the direction of transport T, and the second number indicating the width of the sheets orthogonally to the direction of transport T.

In the block diagram of FIG. 1, each production line, which can be made up of multiple processing stations 01; 02; 03; 04; 06; 07; 08; 09; 11; 12, runs essentially from right to left in terms of the direction of transport T of the printing substrate, with the directional arrows, each of which connects two processing stations 01; 02; 03; 04; 06; 07; 08; 09; 11; 12 to one another, each indicating a transport path to be traversed by the printing substrate and the associated direction of transport T, in order for said substrate to travel from one processing station 01; 02; 03; 04; 06; 07; 08; 09; 11; 12 to the next processing station 01; 02; 03; 04; 06; 07; 08; 09; 11; 12 selected in the machine arrangement designated for the respective production run. Each production run begins with sheets being supplied in processing station 01, with processing station 01 being configured as a feeder 01, e.g. as a sheet feeder 01 or as a magazine feeder 01. A sheet feeder 01 typically receives a pile of sheets, e.g. stacked on a pallet, whereas a magazine feeder 01 has multiple compartments, in each of which sheets, in particular piles, e.g. of different types of sheets or sheets of different formats, are or at least can be placed. Feeder 01 separates the stacked sheets, e.g. by means of a suction head 41, and feeds these in a sequence of mutually separated sheets or in a shingled stream to the next processing station 02; 03; 04; 06 in the particular production run. The next processing station 02; 03; 04 is configured, e.g. as a primer application unit 02 or as a cold foil application unit 03 or as an offset printing unit 04 or as a flexographic printing unit 04. The next processing station 06 may also simply be, e.g. the at least one non-impact printing unit 06. Offset printing unit 04 is preferably configured as a sheet-fed offset printing machine, in particular as a sheet-fed printing machine which has multiple printing couples 86 arranged in an inline configuration. Offset printing unit 04 supplies the sheets with at least one static print image, i.e. a printed image which is invariable during the printing process due to its dependence upon the printing forme that is used, whereas non-impact printing unit 06 supplies the sheets with at least one printed image, the content of which varies or at least may vary.

If the processing station 03 immediately following feeder 01 is the cold foil application unit 03, the sheet is then typically transported from there to processing station 04, which is configured as offset printing unit 04. In cold foil application unit 03, a metallized coating layer, detached from a carrier film, is transferred to the printing substrate. By overprinting this coating layer, e.g. using an offset printing unit 04, a wide variety of metal effects can be achieved. Cold foil application unit 03 is advantageously configured, e.g. as integrated into offset printing unit 04, with two additional printing couples 87; 88 being provided in offset printing unit 04. In the first printing couple 87 in the direction of transport T of the printing substrate, a special adhesive is applied to the printing substrate, i.e. to the sheet, by means of a standard printing forme. A second printing couple 88 in the direction of transport T of the printing substrate is equipped with a foil transfer device which has the coating layer to be transferred. The foil bearing the coating layer is guided from an unrolling station into a printing nip between a transfer cylinder and a printing cylinder that cooperates with said transfer cylinder, and is brought into contact with the printing substrate. Coloring in the coating layer is provided by an aluminum layer and a protective coating layer, the coloring of which influences the color effect. The transfer layers remain bonded to the substrate by adhesion of a bonding layer onto which the adhesive layer is printed. The carrier film is then rolled up again. After the cold foil transfer, overprinting with conventional, e.g. water-based printing inks and with UV and hybrid inks is possible inline, in particular in offset printing unit 04, to produce various metallic color shades.

A printing substrate that is particularly absorbent, for example, and/or is to be prepared for printing with a non-impact printing unit 06 is fed from feed unit 01 to the next processing station 02, configured e.g. as a primer application unit 02, where at least one surface of said printing substrate is coated, e.g. with a water-based primer, in particular to seal said substrate prior to printing or varnishing. Priming involves providing the printing substrate with a base coating or initial coating, in particular to improve or enable the adhesion of a printing ink or ink that will subsequently be applied to the printing substrate. For this purpose, e.g. a white coating is applied to the substrate. Primer application unit 02 is formed, e.g. in conjunction with a printing couple 86 of a rotary printing machine and includes, e.g. a printing couple cylinder 82 cooperating with an impression cylinder 119 and having a forme roller 83, preferably in the form of an anilox roller 83, which is or at least can be thrown onto said printing couple cylinder 82, along with at least one doctor blade 84, in particular a chamber doctor blade system 84, extending in the axial direction of the forme roller 83 (FIGS. 3 to 5, 8 and 9). The primer is applied by means of primer application unit 02 to the printing substrate, either over the entire surface thereof or only at certain, i.e. predefined points, i.e. over a portion of said substrate. The printing substrate, e.g. sheet, processed in primer application unit 02, is then fed, e.g. to an offset printing unit 04 and/or e.g. to a non-impact printing unit 06 as the next processing station.

The flexographic printing carried out by a processing station 04 configured, e.g. as a flexographic printing unit 04 is a direct letterpress process, in which the raised areas of the printing forme are image-bearing and which is frequently used for printing packaging materials made from paper, paperboard or cardboard, metallized film, or a plastic, such as PE, PET, PVC, PS, PP or PC, for example. Flexographic printing uses low viscosity printing inks and flexible printing plates made of photopolymer or rubber. A flexographic printing unit 04 generally includes a) an anilox roller used for inking up the printing forme, b) a printing cylinder, also called a forme cylinder, on which the printing forme is fixed, and c) an impression cylinder which guides the printing substrate.

Each processing station 04, configured as a flexographic printing unit 04 or as an offset printing unit 04, which prints at least one static print image onto each of the sheets, preferably has multiple printing couples 86, e.g. at least four, each printing couple 86 preferably printing with a different ink color, so that as the printing substrate passes through the flexographic printing unit 04 or the offset printing unit 04, it is printed in multiple colors, e.g. in four-color printing. In particular, the color shades yellow, magenta, cyan and black are used as printing ink colors. In an alternative embodiment of printing unit 04 for flexographic printing or offset printing, processing station 04, which prints at least one static print image onto each of the sheets, is configured as a printing unit 04 for printing by a screen printing method.

Once the printing substrate has been processed in the at least one non-impact printing unit 06, this printing substrate is fed, e.g. to a processing station 07 configured as a dryer 07, in particular as an interdeck dryer 07, said interdeck dryer 07 being configured for drying said substrate, e.g. using hot air and/or by irradiation with infrared or ultraviolet radiation, with a dryer that dries by ultraviolet radiation being embodied, e.g., as an LED dryer, and with the type of radiation being dependent, in particular, on whether the printing ink or ink applied to the printing substrate is water-based or UV-curing. After intermediate drying, the printing substrate is fed, e.g. to a processing station 08 configured as a coating unit 08. Coating unit 08 preferably applies, e.g. a transparent or white or colored dispersion coating to the printing substrate, with dispersion coatings consisting essentially of water and binders (resins), along with surfactants for stabilizing these dispersions. A coating unit 08 for applying a dispersion coating to the printing substrate consists of either an anilox roller, a chamber doctor blade, and a forme roller (comparable to a flexographic printing couple), or a dipping roller and a forme roller. Full-surface and/or partial coatings, for example, are applied to the printing substrate by means of a printing forme, preferably based on photopolymerization. For full surface coatings, special coating plates made of rubber may also be used. In the transport path of the printing substrate, a processing station 09 configured, e.g. as a dryer 09 is located downstream of coating unit 08, said dryer 09 being configured to dry the printing substrate in question using hot air and/or by irradiation with infrared or ultraviolet radiation, with a dryer that dries by ultraviolet radiation being embodied, e.g. as an LED dryer. If the machine arrangement in question includes multiple dryers 07; 09 along the transport path of the printing substrate, the dryer denoted by reference symbol 09 is preferably the last of this plurality of dryers 07; 09 in the direction of transport T of the printing substrate, in which case the interdeck dryer(s) 07 and the (final) dryer 09 may be structurally identical or may be structurally different from one another. If a printing substrate to be dried by ultraviolet radiation is fed to dryer 09, i.e. a printing substrate to which a printing ink or ink that is cured by UV-radiation, or a coating which is cured by UV-radiation, e.g. a gloss coating, is applied, said dryer 09 is equipped with a radiation source that generates ultraviolet radiation. Dispersion coatings allow more intense gloss and matte effects to be achieved than with classic oil-based coatings. Special optical effects can be achieved by using effect pigments in the coating. Primer application unit 02, cold foil application unit 03, and coating unit 08 may be combined under the term coating unit 02; 03; 08.

Following the final drying step along its transport path, the printing substrate is fed, e.g. to a processing station 11, which performs further mechanical processing on the printing substrate, e.g. punching or creasing, and/or the separation of parts, in particular the stripping of usable blanks from their points of attachment in the preferably printed sheet. Each of the aforementioned further processing steps is carried out in or by a processing system 46. Further mechanical processing is preferably carried out in cooperation with a cylinder transporting the respective sheet. Thereafter, or directly from the final dryer 09 in the transport path of the printing substrate, the printing substrate advances to a delivery 12, which is the last processing station 12 in each of the production lines shown in FIG. 1, each embodied as a particular arrangement of processing stations 01; 02; 03; 04; 06; 07; 08; 09; 11; 12. In delivery 12, the processed sheets are preferably stacked, e.g. on a pallet.

As illustrated in FIGS. 2 to 8, the aforementioned sequence of processing stations 01; 02; 03; 04; 06; 07; 08; 09; 11; 12 arranged in each machine arrangement is merely exemplary and may be modified based upon the printed product to be produced in each case.

Production lines illustrated by way of example in FIG. 1, which are used in particular for the production of packaging materials, each comprise a machine arrangement containing a selection of processing stations 01; 02; 03; 04; 06; 07; 08; 09; 11; 12 from the aforementioned set. The following production lines are or at least can be formed, for example:

1. Sheet feeder 01; primer application unit 02; non-impact printing unit 06; interdeck dryer 07 with IR radiation source for dispersion coating; coating unit 08; dryer 09 with IR radiation source and/or hot air; delivery 12
2. Sheet feeder 01; primer application unit 02; non-impact printing unit 06; dryer 09 with IR radiation source and/or hot air; delivery 12
3. Sheet feeder 01; primer application unit 02; non-impact printing unit 06; interdeck dryer 07 with IR radiation source; coating unit 08 for dispersion coating and UV-curing coating; dryer 09 with hot air and/or IR radiation source or UV radiation source; delivery 12
4. Sheet feeder 01; cold foil application unit 03; offset printing unit 04; non-impact printing unit 06; dryer 09 with IR radiation source and/or hot air; delivery 12
5. Sheet feeder 01; primer application unit 02; non-impact printing unit 06; interdeck dryer 07 with IR radiation source for dispersion coating; coating unit 08; dryer 09 with hot air and/or IR radiation source; mechanical further processing unit 11; delivery 12
6. Sheet feeder 01; offset printing unit 04; non-impact printing unit 06; interdeck dryer 07 with IR radiation source; mechanical further processing unit 11; delivery 12
7. Sheet feeder 01; non-impact printing unit 06; dryer 09 with hot air and/or IR radiation source; delivery 12
8. Sheet feeder 01; non-impact printing unit 06; interdeck dryer 07 with UV radiation source; dryer 09 with UV radiation source; delivery 12
9. Sheet feeder 01; non-impact printing unit 06; interdeck dryer 07 with UV radiation source; dryer 09 with UV radiation source; mechanical further processing unit 11; delivery 12
10. Sheet feeder 01; non-impact printing unit 06; interdeck dryer 07 with IR radiation source; offset printing unit 04; coating unit 08; dryer 09 with hot air and/or IR radiation source; delivery 12
11. Magazine feeder 01; primer application unit 02; non-impact printing unit 06; interdeck dryer 07 with IR radiation source; coating unit 08; dryer 09 with hot air and/or IR radiation source; delivery 12
12. Magazine feeder 01; primer application unit 02; non-impact printing unit 06; interdeck dryer 07 with IR radiation source; dryer 09 with hot air and/or IR radiation source; mechanical further processing unit 11; delivery 12
13. Magazine feeder 01; non-impact printing unit 06; interdeck dryer 07 with UV radiation source; coating unit 08; dryer 09 with UV radiation source; delivery 12

At least one of the processing stations 01; 02; 03; 04; 07; 08; 09; 11; 12 cooperating with the at least one non-impact printing unit 06 is selected for inclusion in the processing of sheets based upon whether the printing ink to be applied to the sheet, in particular by the non-impact printing unit 06, is a water-based printing ink or ink, or is a UV-curing printing ink or ink. Thus, the respective machine arrangement is configured to print each of the sheets with a water-based printing ink or with UV-curing printing ink.

One advantageous machine arrangement, mentioned here by way of example, comprises multiple processing stations for processing sheets, with the multiple processing stations 01; 02; 03; 04; 06; 07; 08; 09; 11; 12 being arranged one behind the other in the direction of transport T of the sheets for the inline processing of these sheets, wherein at least one of these processing stations 06 is configured as a non-impact printing unit 06, wherein a first processing station 01 located upstream of the non-impact printing unit 06 in the direction of transport T of the sheets is configured as a sheet feeder 01 or as a magazine feeder 01, wherein a processing station 08 located between the first processing station 01 and the non-impact printing unit 06 is configured as a first coating unit 08 for applying a coating to each of the sheets, wherein a first dryer 07 is located between the first coating unit 08 and the non-impact printing unit 06, wherein a first transport cylinder arrangement that includes at least one transport cylinder 39 is provided for transporting the sheets from the first dryer 07 to the non-impact printing unit 06, wherein a second dryer 07 is located downstream of the non-impact printing unit 06 in the direction of transport T of the sheets, wherein a means for transferring the sheets coming from non-impact printing unit 06 to a second coating unit 08 is provided, wherein a third dryer 09 is located downstream of the second coating unit 08, and wherein a delivery 12 for the sheets is located downstream of the third dryer 09 in the direction of transport T of the sheets. A mechanical further processing unit 11 may additionally be located between the third dryer 09 and the delivery 12. In addition, e.g. a coating unit 03 for applying a cold foil is located upstream of the non-impact printing unit 06 in the direction of transport T of the sheets. Non-impact printing unit 06 preferably has multiple individually controlled inkjet printers along the transport path of the sheets. Within the active zone of the non-impact printing unit 06, the sheets are preferably guided, each lying flat on a transport device, wherein the transport device has a curved transport path for the sheets, at least within the active zone of non-impact printing unit 06, and the transport device is configured as a multi-sized printing cylinder 22 within the active zone of non-impact printing unit 06. In the direction of transport T of the sheets, upstream of non-impact printing unit 06, e.g. a transfer device is located, which transfer device aligns each of the sheets, e.g. at least in terms of its axial register and/or its circumferential register, true to register relative to the print position of non-impact printing unit 06, said transfer device including, e.g. a suction drum which holds each of the sheets by means of suction air. This machine arrangement is configured in particular for printing each of the sheets with a water-based printing ink or with a UV-curing printing ink. This machine arrangement is configured, in particular, for producing various packaging materials. The device for transferring the sheets coming from the non-impact printing unit 06 to the second coating unit 08 is configured, for example, as a second transport cylinder arrangement having at least one transport cylinder 39.

Figure 2:
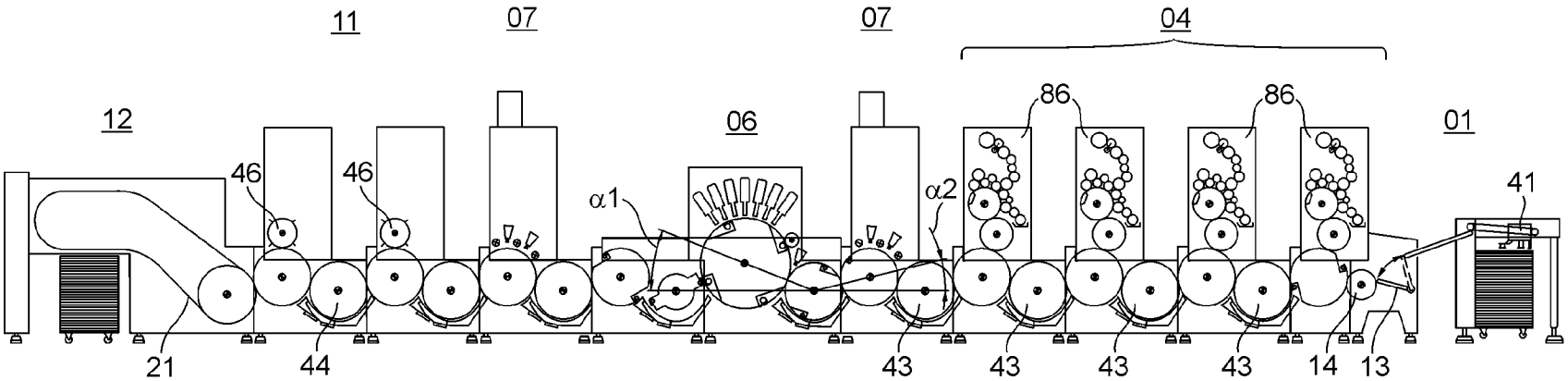
FIG. 2 shows a first machine arrangement having multiple different processing stations.

FIG. 2 shows an example of a machine arrangement having multiple processing stations 01; 02; 03; 04; 06; 07; 08; 09; 11; 12 according to the aforementioned production line No. 6. In a sheet feeder 01, sheets are picked up individually from a pile, e.g. by a suction head 41, and are transferred one after another in a cycle of, e.g. 10,000 sheets per hour, e.g. to an offset printing unit 04 which comprises, e.g. four printing couples 86 arranged in a row. For transferring the sheets from one of the printing couples 86 arranged in a row to the next, a rotary body is provided, in particular a cylinder, preferably a transfer drum 43, in each case arranged between two immediately adjacent printing couples 86. Offset printing unit 04 receives the sheets, which are fed to it by sheet feeder 01, e.g. with a rocking gripper 13, and passes these sheets on to a transfer drum 14 of offset printing unit 04, e.g. configured as single-sized, i.e. transporting only a single substrate at a time on its periphery, after which the sheets are guided in the offset printing unit 04 in a gripper closure from one printing couple 86 to the next. In offset printing unit 04, the sheets are printed on at least one side. If a turning device 23 is provided between the printing units 04, the sheets may also be printed on both sides in offset printing unit 04, i.e. in a recto and verso printing process. After passing through processing station 04, which in this case is configured, e.g. as offset printing unit 04, the sheet in question, which is preferably printed in four colors, is transferred by means of the first transport cylinder arrangement to at least one non-impact printing unit 06. Non-impact printing unit 06 preferably comprises multiple inkjet printers, in particular individually controlled inkjet printers, e.g. five arranged linearly in a row, which print, e.g. with cyan, magenta, yellow, and/or black printing inks and preferably additionally with at least one customer-specific printing ink such as orange and/or green and/or purple, for example. The sheets, which have been provided with at least one static printed image in offset printing unit 04 and with at least one varying or at least variable printed image in non-impact printing unit 06, are then dried in a dryer 07 or interdeck dryer 07, preferably with hot air and/or with an IR radiation source. After drying, the sheets are again further processed in a mechanical further processing unit 11, e.g. by punching and/or creasing and/or the stripping of usable blanks from the respective sheet. Finally, the sheets, and/or the blanks that have been separated from the sheets, are collected, in particular stacked, in a delivery 12. In the active zone of the first gripper system 16 or of the first chain conveyor 16, a delivery 12, in particular a multi-pile delivery, may be provided in each case along the transport path provided for the sheets. Likewise provided, e.g. downstream of mechanical further processing unit 11 in the direction of transport T of the sheets, is a multi-pile delivery. As is clear from FIG. 2, each of the processing stations 02; 03; 04; 06; 07; 08; 09; 11 located in the machine arrangement between the sheet feeder 01 and delivery 12 in the direction of transport T of the sheets is equipped with at least one transport cylinder 39 or other sheet-guiding cylinder 22; 38; 43; 44, with each relevant transport cylinder 39 or other sheet-guiding cylinder 22; 38; 43; 44 being multi-sized, preferably at least double-sized. As is shown in FIGS. 2 to 13, at least one printing cylinder 22; 38 located in the processing station 06 that contains non-impact printing unit 06 is at least triple-sized, preferably quadruple-sized. The coating units 02; 08, i.e. in particular primer application unit 02 and/or finish coating unit 08, preferably each include a double-sized transport cylinder 39 or other sheet-guiding cylinder 43; 44 for sheet transport. With the exception of the relevant printing cylinder 22; 38 located in the at least one processing station 06 that contains the non-impact printing unit 06, all the remaining transport cylinders 39 or other sheet-guiding cylinders 43; 44 in the machine arrangement are equal in size, for example, in particular double-sized.

Sheets are picked up from a pile in feeder 01, in particular sheet feeder 01, and are transported individually, spaced from one another, e.g. through the processing station 02; 03; 04, e.g. offset printing unit 04, disposed upstream of non-impact printing unit 06, at a first transport speed. Sheets that have been transferred from the processing station 02; 03; 04 which is configured, e.g. as offset printing unit 04 and is located upstream of non-impact printing unit 06 to the non-impact printing unit 06 are transported in this non-impact printing unit 06 at a second transport speed, with the second transport speed which is used in non-impact printing unit 06 typically being slower than the first transport speed used, e.g. in offset printing unit 04. To adjust the first transport speed which is used, e.g. in offset printing unit 04 to the typically lower second transport speed used in non-impact printing unit 06, e.g. the sheet gap existing between sheets that follow one another in immediate succession, i.e. the distance that is produced, e.g. by the width of a gripper channel for the sheets that are transported in the gripper closure, e.g. through offset printing unit 04, is preferably decreased as said sheets are being transferred, e.g. from offset printing unit 04 to non-impact printing unit 06, with such a decrease in distance amounting, e.g. to between 1% and 98% of the original distance. Sheets that follow one another in immediate succession are thus also transported spaced from one another in non-impact printing unit 06, but typically with a smaller sheet gap or at a shorter distance than, e.g. in offset printing unit 04, and consequently also at a lower second transport speed. This second transport speed is preferably maintained when sheets that have been printed in non-impact printing unit 06 are transported first to an interdeck dryer 07 or dryer 09 and from there, e.g. by means of a feed table, to mechanical further processing unit 11 and on to delivery 12. However, the sheets can also be brought from their second transport speed to a third transport speed, if required, e.g. by the processing station 08; 09; 11, configured, e.g. as mechanical further processing unit 11 and located downstream of the non-impact printing unit 06, with the third transport speed typically being higher than the second transport speed and corresponding again, e.g. to the first transport speed used in particular in offset printing unit 04. Upstream of the mechanical further processing unit 11, the second transport cylinder arrangement is provided, for example, which picks up the sheets coming from the interdeck dryer 07 or dryer 09 and transports them to mechanical processing device 11. Also in the region of mechanical further processing unit 11, which includes, e.g. multiple processing systems 46 arranged in a row, a rotary body, in particular a cylinder, preferably a transfer drum 44, is provided, arranged between every two adjacent processing systems 46, for the purpose of transferring the sheets from one of the processing systems 46 arranged in a row to the next. One of processing systems 46 is configured, e.g. as a punching system, in particular a rotary punching system, while another processing system 46 is configured, e.g. as a creasing system. The processing system 46 in question is configured to carry out the mechanical further processing of the sheets preferably in cooperation with a cylinder for transporting the respective sheets. Once they have been processed mechanically, the sheets and/or the usable blanks that have been separated from said sheets are transported, e.g. by means of a chain conveyor 21 to delivery 12, where they are collected, preferably stacked.

The sheets are transported from the output of the processing station 02; 03; 04 configured, e.g. as offset printing unit 04 and located upstream of the non-impact printing unit 06, at least up to the output of interdeck dryer 07 or dryer 09, and preferably up to the beginning of the processing station 08; 09; 11 configured, e.g. as mechanical further processing unit 11 and located downstream of non-impact printing unit 06, in each case by means of a multi-component transport device, i.e. consisting of multiple modules, in particular transport units, arranged one behind the other in the direction of transport T of the sheets, the transport device preferably including a plurality of multi-sized transport cylinders 39. If necessary, an interdeck dryer 07 or a dryer 09 may also be provided between offset printing unit 04 and non-impact printing unit 06.

As is also clear from FIG. 2, the respective rotational axes of processing cylinders, such as printing cylinder 22 or the respective cylinders of the primer application unit 02, the finish coating unit 08 or a dryer 07, and of a transport cylinder disposed immediately downstream or immediately upstream of any of these processing cylinders in the direction of transport T of the substrates, are arranged offset vertically. A straight line running through the axis of rotation of a processing cylinder and the axis of rotation of a transport cylinder or a transfer drum located immediately downstream thus forms an acute angle $\alpha 1$ to a horizontal line, and/or a straight line running through the axis of rotation of a processing cylinder and the axis of rotation of a transport cylinder or a transfer drum located immediately upstream forms an acute angle $\alpha 2$ ranging from 15° to 30°, preferably from 20° to 25°, in particular measuring 22.5°, to a horizontal line, each said horizontal line passing, e.g. through the axis of rotation of the transport cylinder in question or through the axis of rotation of the transfer drum in question. The angle $\alpha 1$ directed toward the downstream transport cylinder or toward the downstream transfer drum measures, e.g., between one and two times the angle $\alpha 2$ directed toward the upstream transport cylinder, preferably between 1.3 and 1.7 times, and in particular is 1.5 times the angle $\alpha 2$ directed toward the upstream transport cylinder.

FIGS. 3 to 8 schematically illustrate additional machine arrangements by way of example, each including multiple processing stations 01; 02; 03; 04; 06; 07; 08; 09; 11; 12, with the respective reference signs denoting the processing stations 01; 02; 03; 04; 06; 07; 08; 09; 11; 12 described above, along with additional respective units thereof.

Figure 3:
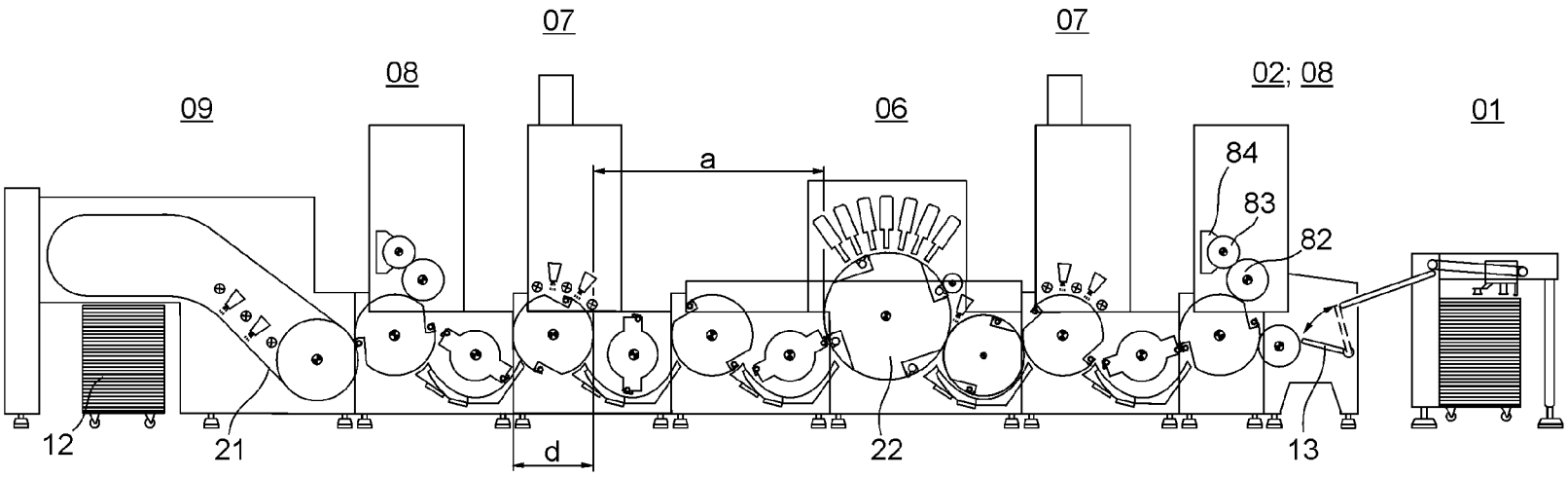
FIGS. 3 to 8 show additional machine arrangements, each having multiple different processing stations.

FIG. 3 shows a machine arrangement comprising the following processing stations 01; 02; 03; 04; 06; 07; 08; 09; 11; 12 arranged one behind the other in the direction of transport T of the printing substrate: sheet feeder 01; primer application unit 02 or finish coating unit 08; interdeck dryer 07; non-impact printing unit 06; interdeck dryer 07; finish coating unit 08; dryer 09; delivery 12.

Figure 4:
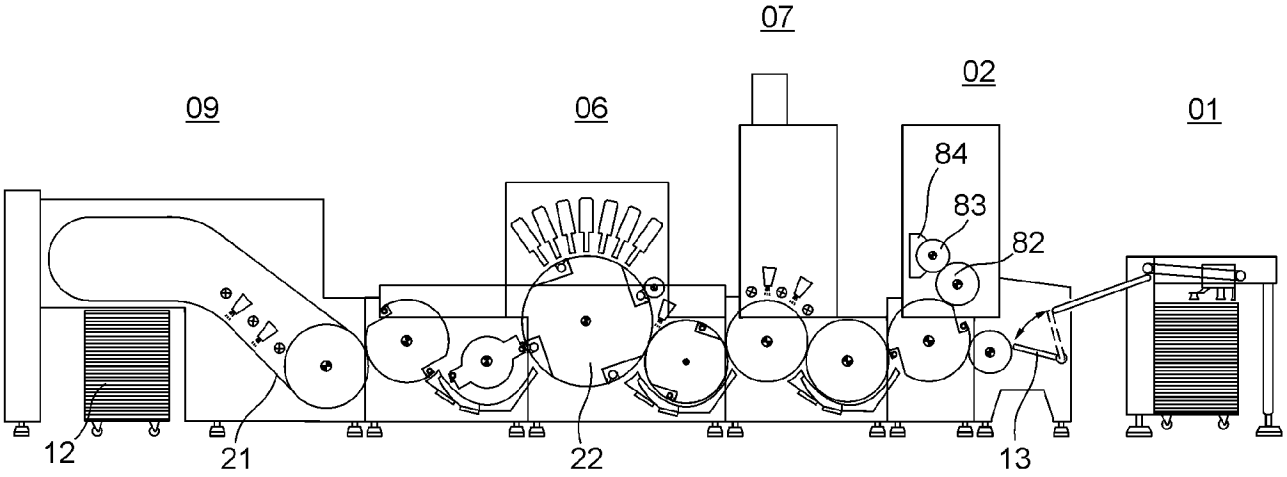

FIG. 4 shows a machine arrangement comprising the following processing stations 01; 02; 03; 04; 06; 07; 08; 09; 11; 12 arranged one behind the other in the direction of transport T of the printing substrate: sheet feeder 01; primer application unit 02; interdeck dryer 07; non-impact printing unit 06; dryer 09; delivery 12.

Figure 5:
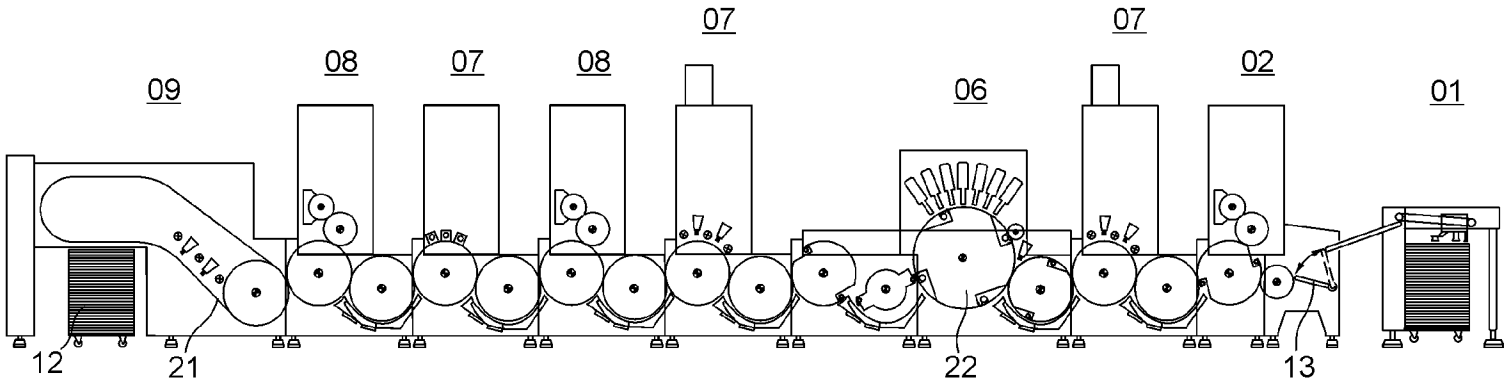

FIG. 5 shows a machine arrangement comprising the following processing stations 01; 02; 03; 04; 06; 07; 08; 09; 11; 12 arranged one behind the other in the direction of transport T of the printing substrate: sheet feeder 01; primer application unit 02; interdeck dryer 07; non-impact printing unit 06; interdeck dryer 07; finish coating unit 08; interdeck dryer 07; finish coating unit 08; dryer 09; delivery 12.

Figure 6:
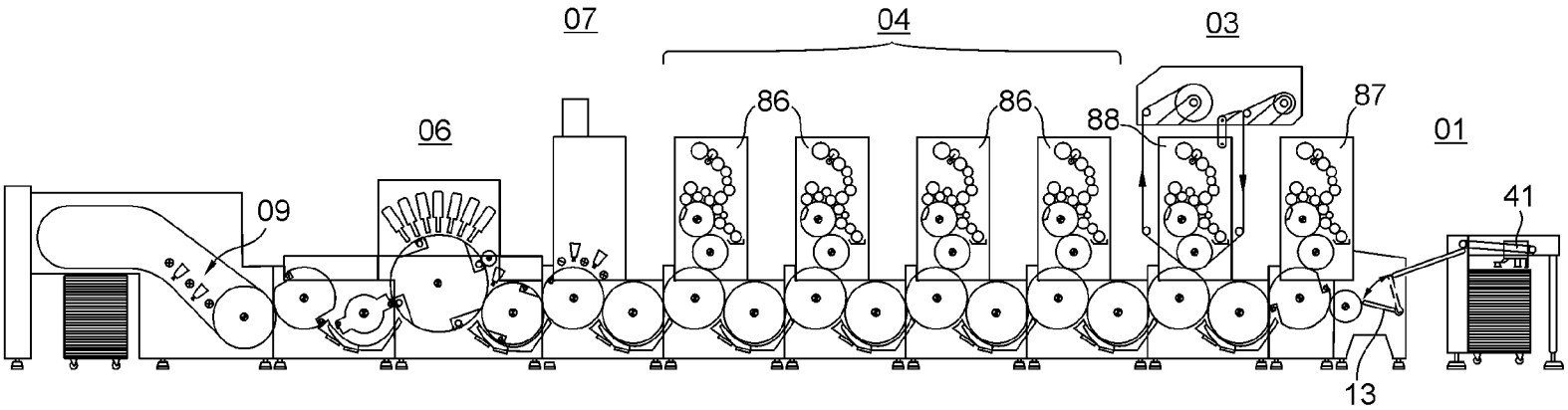

FIG. 6 shows a machine arrangement comprising the following processing stations 01; 02; 03; 04; 06; 07; 08; 09; 11; 12 arranged one behind the other in the direction of transport T of the printing substrate: sheet feeder 01; a first offset printing unit 04; cold foil application unit 03; four additional offset printing units 04 in an inline configuration; interdeck dryer 07; non-impact printing unit 06; interdeck dryer 07; non-impact printing unit 06; dryer 09; delivery 12.

Figure 7:
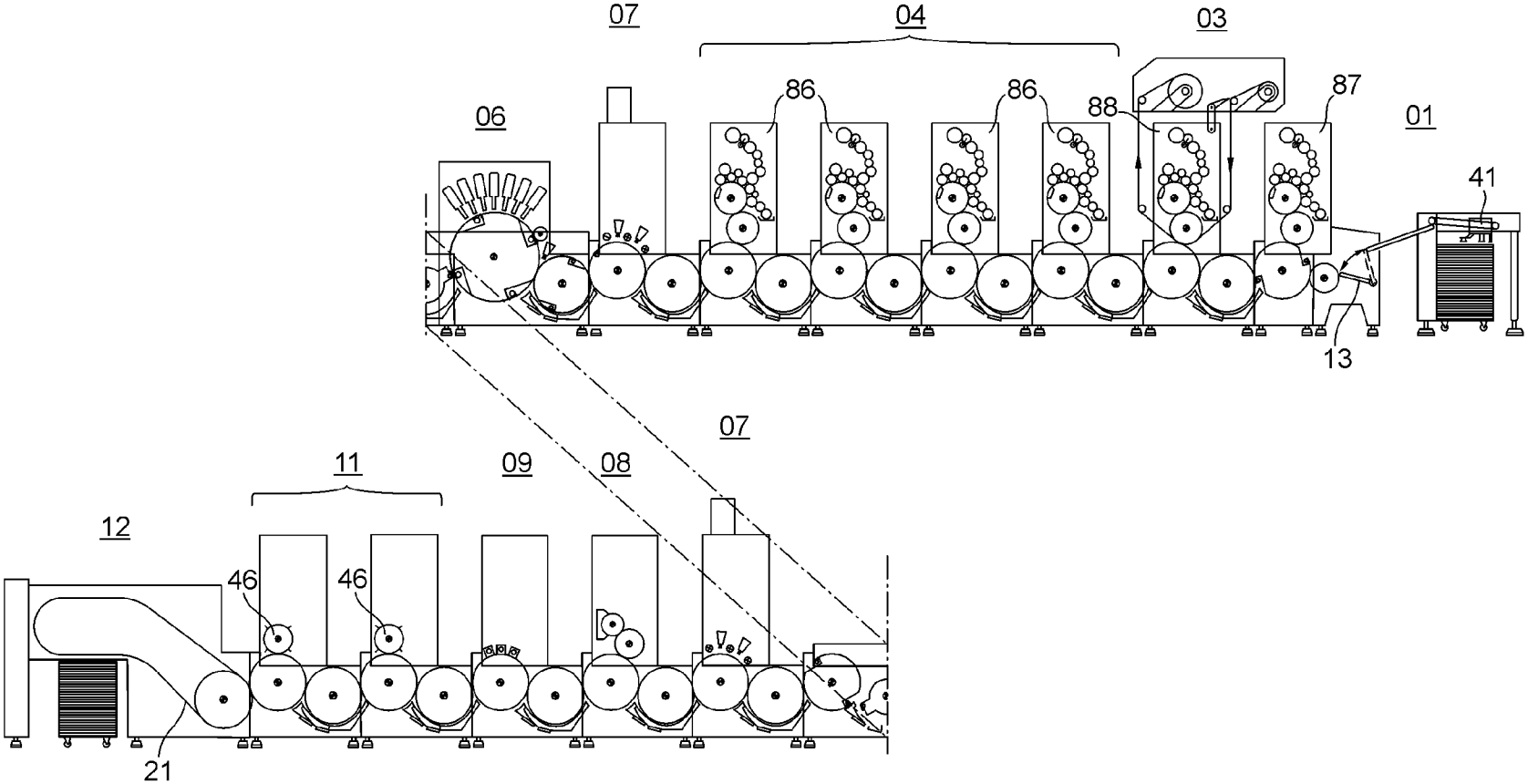

FIG. 7 shows a machine arrangement comprising the following processing stations 01; 02; 03; 04; 06; 07; 08; 09; 11; 12 arranged one behind the other in the direction of transport T of the printing substrate, with the machine arrangement being shown offset in the diagram due to its length: sheet feeder 01; a first offset printing unit 04; cold foil application unit 03; four additional offset printing units 04 in an inline configuration; interdeck dryer 07; non-impact printing unit 06; interdeck dryer 07; coating unit 08; dryer 09; two mechanical further processing units 11 in an inline configuration; delivery 12.

Figure 8:
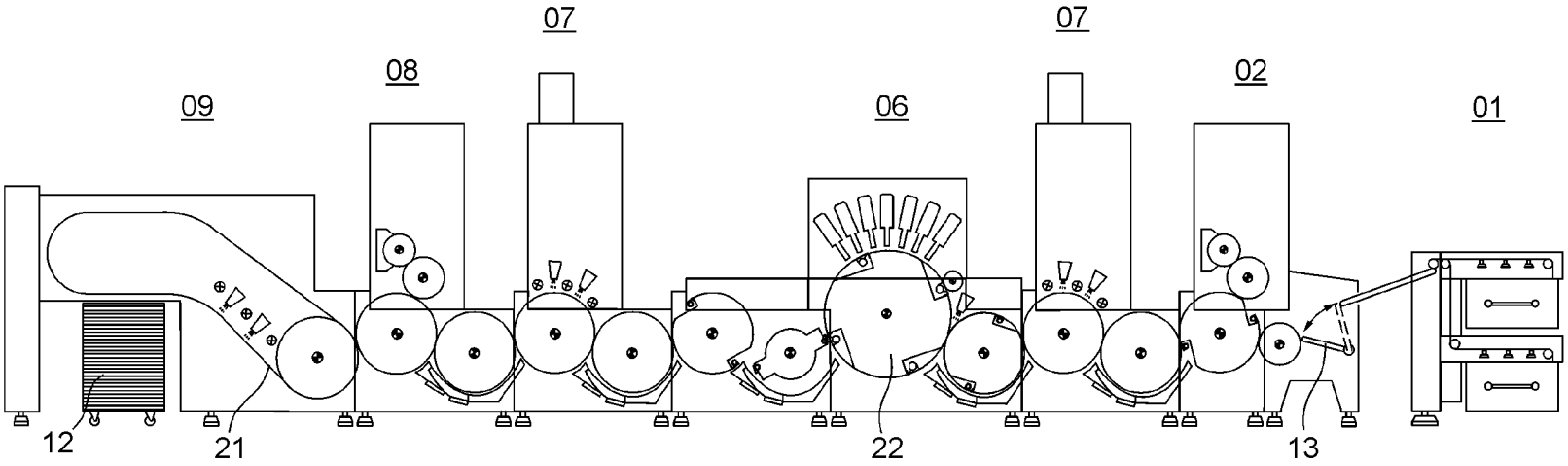

FIG. 8 shows a machine arrangement comprising the following processing stations 01; 02; 03; 04; 06; 07; 08; 09; 11; 12 arranged one behind the other in the direction of transport T of the printing substrate: magazine feeder 01; primer application unit 02; interdeck dryer 07; non-impact printing unit 06; interdeck dryer 07; finish coating unit 08; dryer 09; delivery 12.

As has already been mentioned, the above-described machine arrangements, each of which comprises multiple processing stations 01; 02; 03; 04; 06; 07; 08; 09; 11; 12 for processing sheets and at least one transport device for transporting these sheets, are configured for the purpose of processing sheets of different formats, i.e. of different lengths and/or widths. The typically rectangular sheets therefore differ, e.g. in terms of their respective length, with said length extending in the direction of transport T of said sheets. To avoid any decrease in the productivity of a machine arrangement when a processing station 02; 03; 04; 06; 07; 08; 09; 11; 12 configured in particular as a non-impact printing unit 06 to which multiple sheets are fed in sequence is being used with comparatively shorter sheets, i.e. with sheets of smaller format than the larger format sheets that are otherwise processed in said machine arrangement, a method comprising the following steps is proposed:

A method for operating a transport device for feeding multiple sheets in sequence to a processing station 02; 03; 04; 06; 07; 08; 09; 11; 12, in which sheets of different lengths, said length extending in direction of transport T of said sheets in each case, are used for processing by the same processing station 02; 03; 04; 06; 07; 08; 09; 11; 12, wherein the sheets to be fed in succession to the processing station 02; 03; 04; 06; 07; 08; 09; 11; 12 are transported by the transport device spaced apart from one another, wherein the transport device impresses a transport speed onto each of the sheets to be transported, and wherein the distance between sheets that follow one another in immediate succession is kept constant for sheets of different lengths each extending in the direction of transport T of said sheets by adjusting the transport speed to be impressed by the transport device onto the sheet in question, the transport speed of each subsequent sheet in the direction of transport T is adjusted relative to the transport speed of the sheet immediately preceding it. In this method, the sheets to be fed in succession to the processing station 02; 03; 04; 06; 07; 08; 09; 11; 12 in question are each preferably transported by the transport device spaced apart by a minimal distance, but typically by a distance not equal to zero, in order to achieve and/or maintain a high level of productivity of the processing stations 02; 03; 04; 06; 07; 08; 09; 11; 12. The distance between successive sheets in the direction of transport T, i.e. between the trailing edge of a preceding sheet, said edge extending transversely to direction of transport T, and the leading edge of the sheet immediately following it, said edge extending transversely to the direction of transport T, ranges, e.g. between 0.5 mm and 50 mm, and is preferably less than 10 mm. When a shorter sheet will be processed after a longer sheet in the processing station 02; 03; 04; 06; 07; 08; 09; 11; 12 in question, the shorter sheet is accelerated by the transport device by increasing its transport speed. Conversely, a longer sheet is decelerated by the transport device by decreasing its transport speed when the longer sheet will be processed following a shorter sheet in the processing station 02; 03; 04; 06; 07; 08; 09; 11; 12 in question. As the processing station 02; 03; 04; 06; 07; 08; 09; 11; 12, a non-impact printing unit 06 is preferably used, the productivity of which is generally at its maximum when the sheets to be printed by said printing unit are fed to it in succession spaced apart by a constant minimal distance, regardless of their respective format. If a processing station 04 configured, e.g. as an offset printing unit 04 is located upstream of the non-impact printing unit 06 in the machine arrangement in question, sheets printed in the offset printing unit 04 are fed to the transport device at the transport speed that corresponds to the production speed of said offset printing unit 04, regardless of their respective format, in which case the transport speed specified for these sheets by the offset printing unit 04 is adjusted to the transport speed that corresponds to the processing speed of the non-impact printing unit 06, while said sheets are being transported by the transport device. If these sheets will also be fed to non-impact printing unit 06 spaced by a constant distance from one another, regardless of their respective format, longer sheets will be decelerated less than shorter sheets, although a decrease in their respective transport speeds will be necessary in any case since the processing speed of non-impact printing unit 06 is typically slower than the production speed of offset printing unit 04.

Each respective sheet is preferably held in a force-fitting and/or a form-fitting attachment by holding means, e.g. by suction air and/or by grippers, during its transport from one processing station 01; 02; 03; 04; 06; 07; 08; 09; 11; 12 to the next and/or also within said processing stations 01; 02; 03; 04; 06; 07; 08; 09; 11; 12, each of which is configured as a module, by the respective transport device, which comprises multiple transport cylinders one behind the other in the direction of transport T of the sheets.

In a preferred embodiment, the transport speed to be impressed upon the sheet in question is adjusted from a preferably electronic control unit located, e.g. on a control console of the machine arrangement, in which case the control unit performs the adjustment of the transport speed, in particular for the purpose of maintaining a constant distance between successive sheets, e.g. in a control loop. It is provided, for example, that a sheet that will be fed to mechanical further processing unit 11 is brought from the second transport speed to the third transport speed by means of rocking gripper 19 and, e.g. single-sized, transfer drum 31, meaning that the sheet in question is accelerated, in particular, by the rotation of transfer drum 31, controlled by the control unit.

Figure 9:
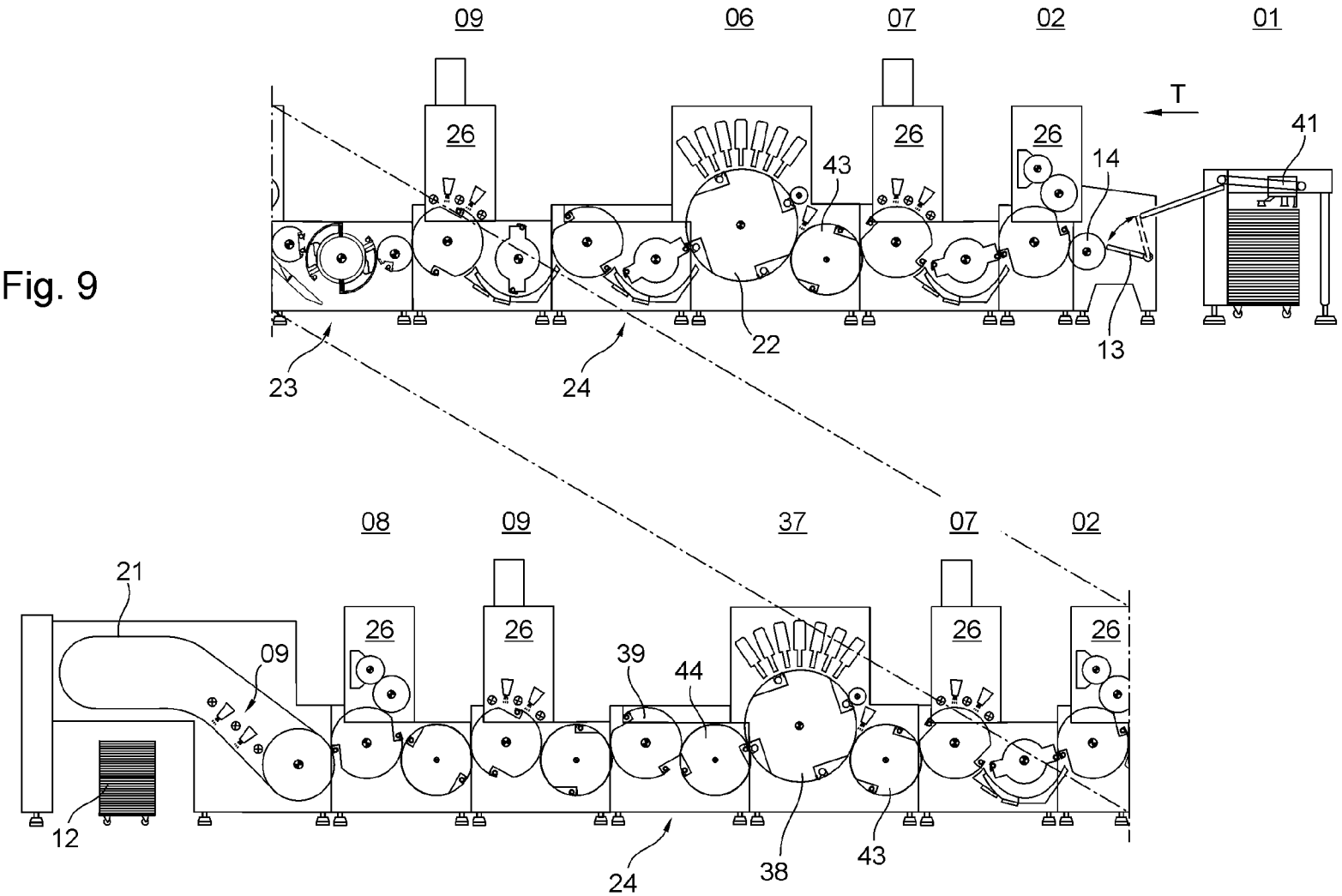
FIG. 9 shows yet another machine arrangement having a turning device for the duplex, sequential processing of multiple sheet-type substrates.

FIG. 9 shows an example of a machine arrangement comprising multiple processing stations 01; 02; 03; 04; 06; 07; 08; 09; 11; 12, the processing stations 01; 02; 03; 04; 06; 07; 08; 09; 11; 12 being arranged one behind the other in the direction of transport T of the substrates. Each of the processing stations 01; 02; 03; 04; 06; 07; 08; 09; 11; 12 arranged in a row is configured as an independently functioning module, with each module forming a machine unit mounted in its own frame. In the preferred embodiment, each module that is configured as a coating unit 02; 03; 08 (i.e. primer application unit 02, cold foil application unit 03, or finish coating unit 08) or as a dryer 07; 09 or as a printing unit 04; 06 or as a mechanical further processing unit 11 is equipped with a substrate guiding unit 24 and a substrate processing unit 26. For transporting the substrates, substrate guiding unit 24 has, e.g., a transport cylinder arrangement comprising one or more transport cylinders 39 or one or more transfer drums 43; 44, the transport cylinders 39 or transfer drums 43; 44 being multiple-sized, preferably double-sized or triple-sized. Depending upon the type of processing station 01; 02; 03; 04; 06; 07; 08; 09; 11; 12 in question, substrate processing unit 26 comprises, e.g. the actual coating unit 02; 03; 08 or the dryer 07; 09 or at least one printing system 86; 87; 88 of the printing unit 04; 06 or at least one processing system 46 of the mechanical further processing unit 11. The substrate guiding unit 24 and the substrate processing unit 26 each have a substantially horizontal joining surface at the point where they are joined and thus form a substructure module 24 and a superstructure module 26, as it were.

The machine arrangement shown in FIG. 9 is a machine arrangement for recto and verso printing and comprises a feeder 01, which is configured as a sheet feeder 01 or magazine feeder 01 and which grips stacked substrates one after the other, e.g. using a suction head 41, and downstream of said feeder, a rocking gripper 13 with a transfer drum 14 in the direction of transport T of the substrates (sheets), followed by a coating unit 02; 03; 08, in particular in the form of a first primer application unit 02, and then a first dryer 07, all arranged one behind the other. The substrates that have thereby been pretreated on their front surface are then fed to a first non-impact printing unit 06 having a first printing cylinder 22, which prints onto the front surface of each of the substrates, with said first printing cylinder 22 preferably being triple-sized or quadruple-sized, meaning that this first printing cylinder 22 has at least enough holding elements on its periphery that three or four substrates are or at least can be arranged one behind the other on its periphery, each being held in place in a force-fitting and/or in a form-fitting manner. In general, at least one holding means or holding element is assigned to each substrate to be held on the periphery of printing cylinder 22, and holding elements that are assigned to different substrates can each be operated independently of one another, i.e. separately from one another. Holding elements configured as grippers are arranged in particular in an open channel on the lateral surface of the printing cylinder 22 in question, said channel extending axially along the lateral surface of the printing cylinder 22 in question. If four substrates can be arranged along the periphery of the printing cylinder 22 in question, for example, this means that said printing cylinder 22 has four channels, with at least one holding element being located in each channel. It is also possible, e.g. for at least two holding elements to be arranged in one channel, in which case one of these holding elements holds the trailing edge of a first of these substrates in the direction of transport T of the substrates and the other of these holding elements holds the leading edge of a second substrate, immediately following the first substrate in the direction of transport T of the substrates, on the periphery of the printing cylinder 22 in question. Multiple inkjet printing units are preferably arranged in succession along part of the periphery of the first printing cylinder 22, wherein the radial distance between the ink outlet opening of a respective inkjet printing unit and the upper surface of the substrate being held on the lateral surface of the rotating printing cylinder 22 in question as said substrate passes through the inkjet printing unit in question is preferably only a few millimeters, in particular only about 1 mm. In the preferred embodiment, the first non-impact printing unit 06 is followed by a substrate guiding unit 24 configured solely as a transport module, without an additional substrate processing unit 26. This transport module is also arranged in its own frame. This substrate guiding unit 24 enables the formation in this machine arrangement of a transverse catwalk platform of sufficient width, which improves accessibility to the first non-impact printing unit 06, e.g. for maintenance and/or repair work. In another embodiment, a substrate guiding unit 24 configured solely as a transport module, without an additional substrate processing unit 26, is alternatively or additionally located upstream of the first non-impact printing unit 06. By positioning the transport module, which comprises, e.g., two double-sized transport cylinders or transfer drums, in the machine arrangement, a configuration is achieved in which the horizontal distance a between the lateral surface of printing cylinder 22 and the, in particular double-sized, processing cylinder of the next processing station in the direction of transport T of the substrates is equal to at least twice the diameter d of said processing cylinder (FIG. 3). Downstream of substrate guiding unit 24, a second dryer 09 for drying the printed front surface of the substrates is provided. The second dryer 09 is followed, e.g., by a turning device 23, which enables the rear surface of the substrates to also be printed as the process progresses. As described above in connection with recto printing, i.e. for printing the front surface, substrates coming from turning device 23 are thus fed first to a second primer application unit 02 for treating the rear surface of the substrates and then to a third dryer 07. This is followed by a second non-impact printing unit 37 having a second printing cylinder 38, which prints on the reverse side of each of the substrates, this second printing cylinder 38 in turn preferably being triple-sized or quadruple-sized, meaning that this second printing cylinder 38 has enough holding means or holding elements on its periphery that three or four substrates are or at least can be held on its periphery, arranged one behind the other, each being held in place in a force-fitting and/or in a form-fitting manner. Along a part of the circumference of the second printing cylinder 38, i.e. on the periphery thereof, preferably multiple inkjet printing units, e.g. at least four or in particular seven inkjet printing units, are arranged in succession, with these inkjet printing units printing, e.g., with cyan, magenta, yellow and/or black printing ink colors and, e.g., with at least one of the special ink colors orange and/or green and/or purple. Turning device 23 is thus located between the first non-impact printing unit 06 and the second non-impact printing unit 37 in the direction of transport T of the substrates. For the same reason as described above, a substrate guiding unit 24 without an additional substrate processing unit 26 is preferably also provided downstream of and/or upstream of the second non-impact printing unit 37. This is followed by a fourth dryer 09 for drying the printed rear side of the substrates. In the preferred embodiment, said dryer is followed by a finish coating unit 08. The coated substrates are then dried in an additional dryer 09, said dryer 09 being located, e.g. in the transport path of a transport device configured as a chain conveyor 21, and said transport device transports the substrates to a delivery 12, in particular to a multi-pile delivery, where they are then delivered. In the machine arrangement shown by way of example in FIG. 9, the respective substrate guiding units 24, each of which comprises a transport cylinder arrangement, are preferably each double-sized, apart from the two printing cylinders 22, so that two substrates are or at least can be arranged one behind the other on the periphery of each of the respective transport cylinders 39 or transfer drums 43; 44. The dryers 07; 09 are configured, e.g., as a UV dryer or as an IR dryer or as a microwave dryer, if necessary in combination with a hot-air dryer. The UV dryers and/or IR dryers are each configured, e.g., as an LED dryer. A microwave dryer uses microwaves at a frequency ranging, e.g. from 2 to 300 GHz, preferably from 2.45 to 22.35 GHz. It is also possible for at least two of the aforementioned drying methods to be used in combination in a dryer.

In turning device 23, turning is typically carried out based upon the principle of trailing edge turning. Turning device 23 may be configured, for example, as a three-drum turner or as a single-drum turner. In the three-drum turner, three substrate guiding cylinders are provided. In that case, for example, a single-sized or double-sized transfer drum, a preferably double-sized storage drum, and a preferably single-sized turning drum are provided in the direction of transport T of the substrates. A single-sized cylinder is able to accommodate one substrate of maximum format on its peripheral surface. In an offset printing unit, for example, a single-sized cylinder thus has the same diameter as a forme cylinder configured, e.g. as a plate cylinder, whereas a double-sized cylinder has a diameter of double size.

The turning drum is equipped in particular with a turning gripper system, in which case, the storage drum is equipped with at least one substrate holding system for each substrate-bearing lateral cylinder surface area. These substrate holding systems are preferably configured as a gripper system for gripping the leading edge of the substrate in the direction of transport T. Fixing elements for fixing the trailing area of a substrate in place are preferably also provided, each preferably configured as a system of suckers. The sucker systems are preferably connected to displaceable rear cylinder shell segments and are preferably displaceable circumferentially relative to the gripper systems on forward shell segments, so that substrates ranging from maximum to minimum format can be held in both their leading and their trailing areas on the storage drum in the straight printing mode and/or in the recto and verso printing mode. Substrate guiding elements for guiding the substrates can be situated below the storage drum and/or the turning drum. As a further refinement, a guiding doctor blade for guiding the substrate between the storage drum and the turning drum is assigned to turning device 23.

Figure 10:
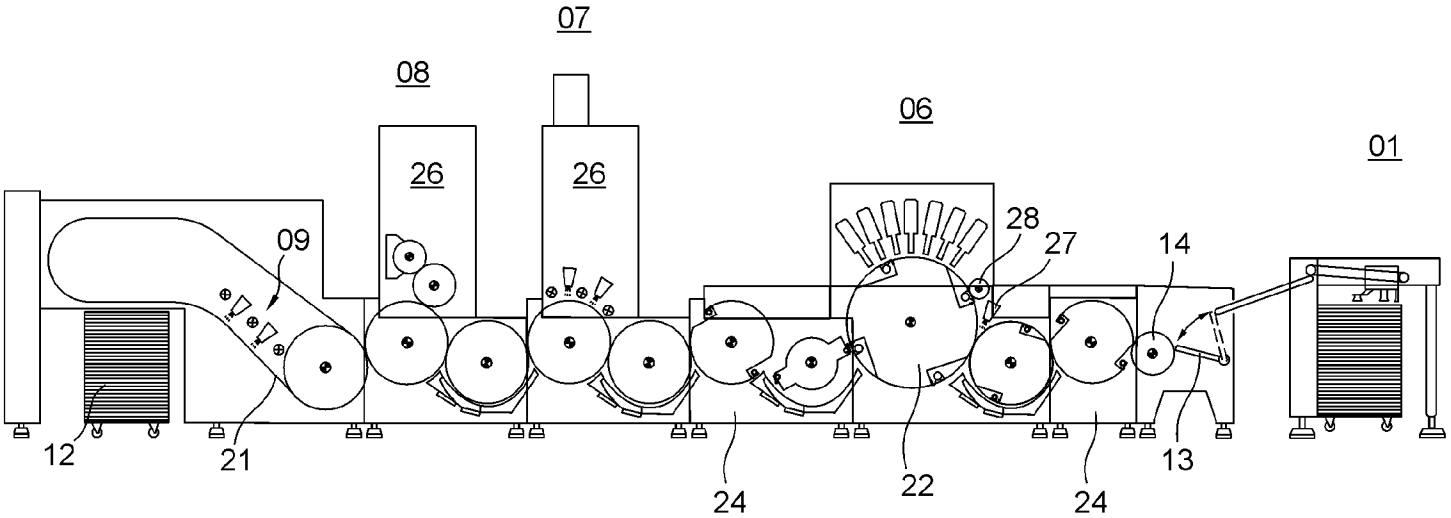
FIG. 10 shows a machine arrangement having substrate guiding units of different lengths.

FIG. 10 shows an example of a machine arrangement for the one-sided processing, in particular the one-sided printing, of substrates. The substrates coming from a feeder 01 are transferred by means of a rocking gripper 13 to, e.g. a single-sized transfer drum 14, and from there are fed via a substrate guiding unit 24 which comprises, e.g. only a single transport cylinder 39 or only a single transfer drum 43; 44 to a non-impact printing unit 06 having a printing cylinder 22 of triple or quadruple size for printing onto the front surface of each of the substrates. To improve the seating of the substrates on the lateral surface of printing cylinder 22, i.e. to assist in holding down the substrate which is resting on the lateral surface of printing cylinder 22, e.g. a blower air device 27 and/or a pressing element 28, e.g. in the form of a smoothing roller or an ironing roller, is provided upstream of the at least one non-impact printing unit 06 arranged on the periphery of printing cylinder 22, in the direction of rotation thereof, with the blower air device 27 and/or the pressing element 28 each extending orthogonally to the direction of transport T of the substrates, preferably each over the entire width thereof. This is followed, e.g. by a substrate guiding unit 24 comprising a transport cylinder assembly that includes at least two transport cylinders 39 or transfer drums 43; 44. Said unit is followed by a dryer 07 and a finish coating unit 08. After being coated, the substrates are dried in an additional dryer 09, this dryer 09 again being situated, e.g. in the transport path of a transport device configured as a chain conveyor 21, and this transport device transports the substrates to a delivery 12 and delivers them. With the exception of printing cylinder 22, the transport cylinders 39 or transfer drums 43; 44 of each of the substrate guiding units 24 are configured, e.g. as double-sized. The substrate guiding unit 24 preferably located downstream or also upstream of the non-impact printing unit 06 and having a transport cylinder arrangement that comprises at least two transport cylinders 39 or transfer drums 43; 44 extends in the direction of transport T of the substrates over a length that corresponds to at least one-and-a-half times the diameter of the relevant transport cylinder 39 or the relevant transfer drum 43; 44.

Figure 11:
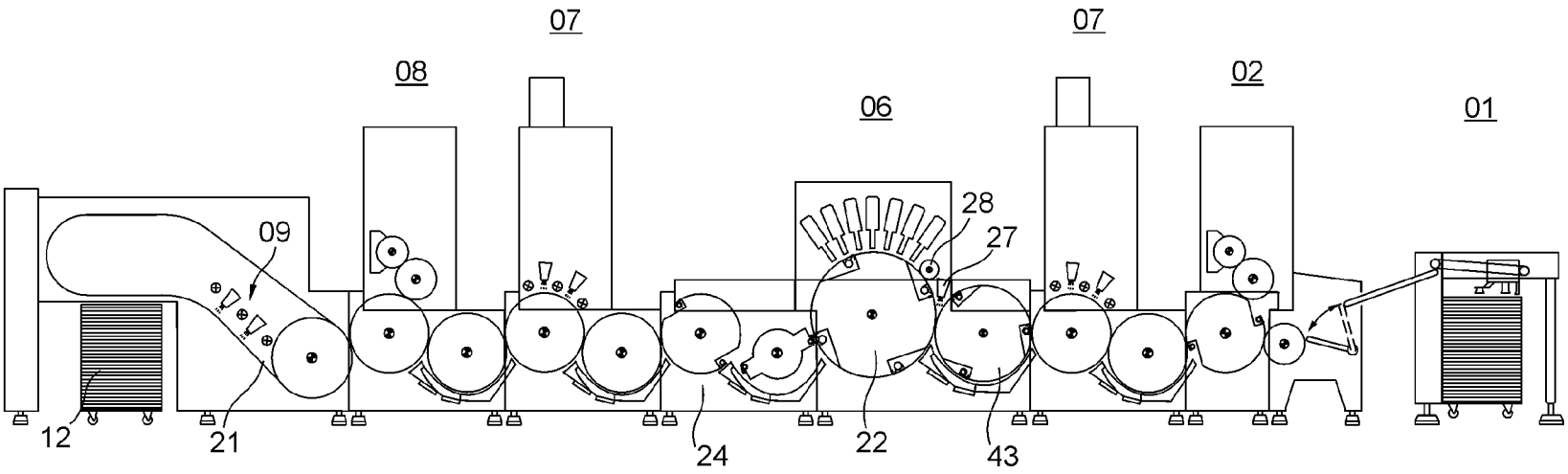
FIGS. 11 to 13 show machine arrangements that include a printing cylinder and a transfer drum in various formats.
Figure 12:
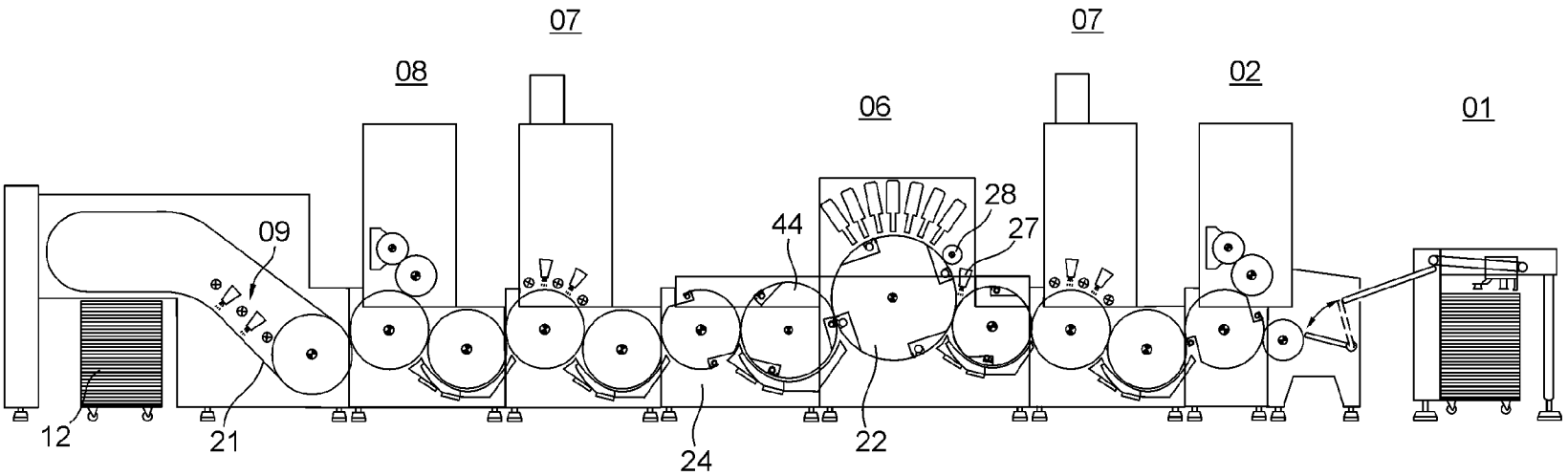
Figure 13:
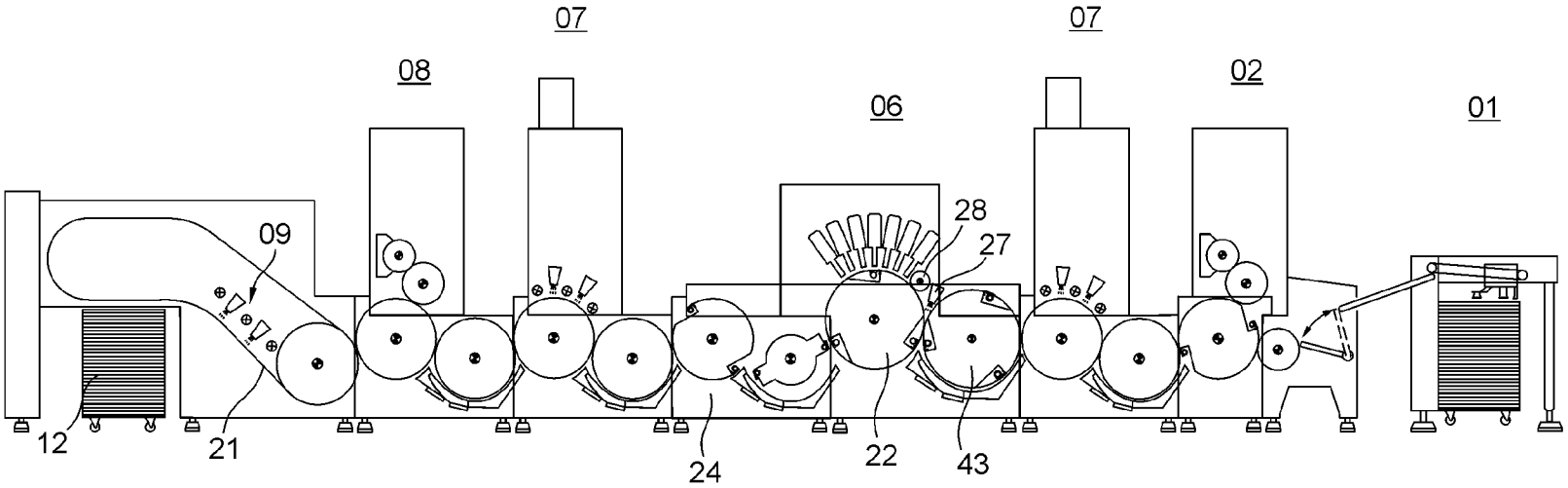

FIGS. 11 to 13 each show an example of a machine arrangement for the one-sided processing, in particular the one-sided printing, of substrates, in which, e.g. a primer application unit 02 and a dryer 07 are provided downstream of feeder 01. These are followed in the direction of transport T of the substrates in the machine arrangement by a non-impact printing unit 06, a substrate guiding unit 24, an additional dryer 07, a finish coating unit 08, and a dryer 09, situated, e.g., in the transport path of a transport device configured as a chain conveyor 21, which transport device transports the substrates to a delivery 12, where they are delivered.

In the machine arrangement of FIG. 11, printing cylinder 22 is configured, e.g. as quadruple-sized. The quadruple-sized printing cylinder 22 receives the substrates to be printed from a transfer drum 43 located immediately upstream, which in the example shown is triple-sized. In the machine arrangement of FIG. 12, printing cylinder 22 is likewise quadruple-sized, but the quadruple-sized printing cylinder 22 transfers the printed substrates to a triple-sized transfer drum 44 located immediately downstream of said printing cylinder 22. FIG. 12 shows the quadruple-sized printing cylinder 22 with a double-sized transfer drum 43 immediately upstream of said printing cylinder 22. Thus, a multi-sized transfer drum 43 can be positioned immediately upstream of printing cylinder 22 and a multi-sized transfer drum 44 can be positioned immediately downstream of said printing cylinder. The lateral surface of printing cylinder 22 and the lateral surface, in particular of the transfer drum 43 located immediately upstream of said printing cylinder 22 are or at least can be thrown onto one another, for example, in such a way that a nip 32 for guiding the respective substrate is formed between them, with the respective width of said nip 32 preferably being adjusted based upon the respective substrate, in particular its material thickness, i.e. its thickness or grammage, the grammage of the substrate ranging, e.g. from 7 $g/m^2$ to 600 $g/m^2$. The width of nip 32, which is preferably infinitely variable, ranges, e.g. from 0 to 3 mm, in particular from 0.1 mm to 1 mm.

In the machine arrangement of FIG. 13, printing cylinder 22 and the transfer drum 43 located immediately upstream of said printing cylinder 22 are each configured as triple-sized. The machine arrangements of FIGS. 11 to 13 differ from one another in terms of the format of printing cylinder 22 and the format of a transfer drum 43; 44 located immediately upstream or immediately downstream of said printing cylinder 22. A quadruple-sized printing cylinder 22, as shown by way of example in FIG. 12, has a diameter, e.g. of around 1,200 mm. A double-sized transfer drum 43 cooperating with this printing cylinder 22, for example, has a diameter, e.g. of around 600 mm. The respective formats of printing cylinder 22 and of a transfer drum 43; 44 located immediately upstream or immediately downstream of said printing cylinder 22 are determined by the number of fields 51; 52; 53; 54 provided one behind the other on the respective peripheries of said cylinder and said transfer drum, each field provided for the positioning of at least one substrate, and/or by the number of holding elements provided in particular in conjunction with said fields 51; 52; 53; 54, which holding elements hold each respective substrate in a force-fitting and/or a form-fitting manner on the periphery of the printing cylinder 22 in question or the transfer drum 43; 44 in question. On the periphery of the relevant printing cylinder 22, multiple inkjet printing units are provided at a radial distance of preferably only a few millimeters, in particular only about 1 mm, between the ink outlet opening of the inkjet printing unit in question and the upper surface of the substrate being held on the lateral surface of said rotating printing cylinder 22 as said substrate passes through the inkjet printing unit in question, along with, e.g. a blower air device 27 and/or a pressing element 28, e.g. in the form of a smoothing roller, with the blower air device 27 and/or the pressing element 28 each extending orthogonally to the direction of transport T of the substrates, each preferably over the entire width thereof. The smoothing roller is equipped, e.g. with its own rotary drive, e.g. a preferably electric motor which can be controlled or regulated by a control unit and with which a slight slip, i.e. a difference in speed from the rotation of the relevant printing cylinder 22, is or at least can be adjusted. The slip serves to tauten the respective substrate being transferred to the printing cylinder 22.

The machine arrangements shown in FIGS. 2 to 13 are or at least can be used to particular advantage in conjunction with UV-curing printing inks, e.g. for printing packaging materials for foods or cosmetics.

Figure 14:
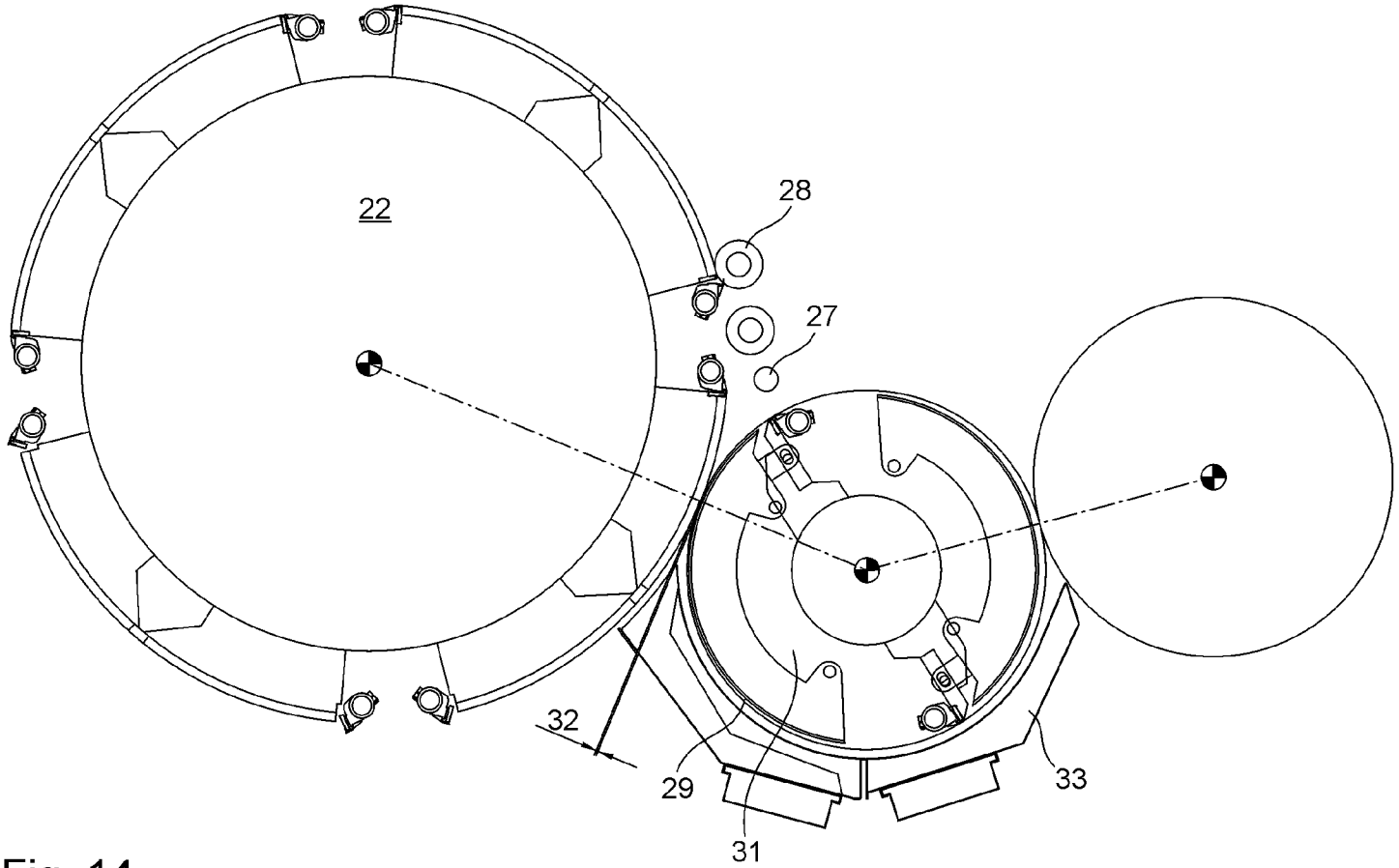
FIG. 14 shows a detailed diagram of a printing cylinder and a transfer drum.

FIG. 14 is a detailed diagram of a printing cylinder 22; 38, e.g. quadruple-sized, and of a transfer drum 43, also called a feed drum or feed cylinder, which is double-sized and is located immediately upstream of said printing cylinder 22;

38, said transfer drum 43 having multiple, in particular two, e.g. eccentrically displaceable cylinder surfaces 29. At least one transfer cylinder 39, for example, configured, e.g. as double-sized or triple-sized, is located upstream of transfer drum 43 in the direction of transport T of the substrates, wherein a nip which preferably is or at least can be adjusted based upon the printing substrate, in particular based upon the material thickness of the substrates, also is or at least can be formed between the transfer drum 43 and the transfer cylinder 39 located immediately upstream of said transfer drum 43. An additional transfer cylinder 39, e.g. of double or triple size, not shown in FIG. 14, or a transfer drum 44 of double or triple size, may each likewise be located immediately downstream of the printing cylinder 22; 38. A quadruple-sized printing cylinder 22; 38 has four fields 51; 52; 53; 54 one behind the other in the circumferential direction, in each of which a substrate can be held on the lateral surface of the printing cylinder 22; 38 in question. Every two successive fields 51; 52; 53; 54 are separated from one another, e.g. by a channel 62 or by a cylinder pit 62, for example. The preferably compressible and/or elastic cylinder surfaces 29 of the transfer drum 43, or the transfer drum 43 as a whole, are each mounted, e.g., in an eccentric bearing 31 configured, e.g. as an eccentric bushing, and are thus eccentrically adjustable, in particular remotely adjustable by a control unit. The lateral surface of the printing cylinder 22; 38 and the transfer drum 43, for example, are or at least can be thrown onto one another, e.g. to form the nip 32 for guiding the respective substrate between them, the respective width of this nip 32 preferably being adjusted on the basis of the material thickness, i.e. the thickness or grammage of the respective substrate. With the eccentric displacement of the cylinder surfaces 29 of transfer drum 43, or with the eccentric displacement of transfer drum 43 as a whole, both the nip 32 between the lateral surface of printing cylinder 22; 38 and the lateral surface of transfer drum 43 and the nip between this transfer drum 43 and the transfer cylinder 39 located immediately upstream thereof preferably are or at least can be adjusted at the same time, in particular based upon the printing substrate.

Figure 19:
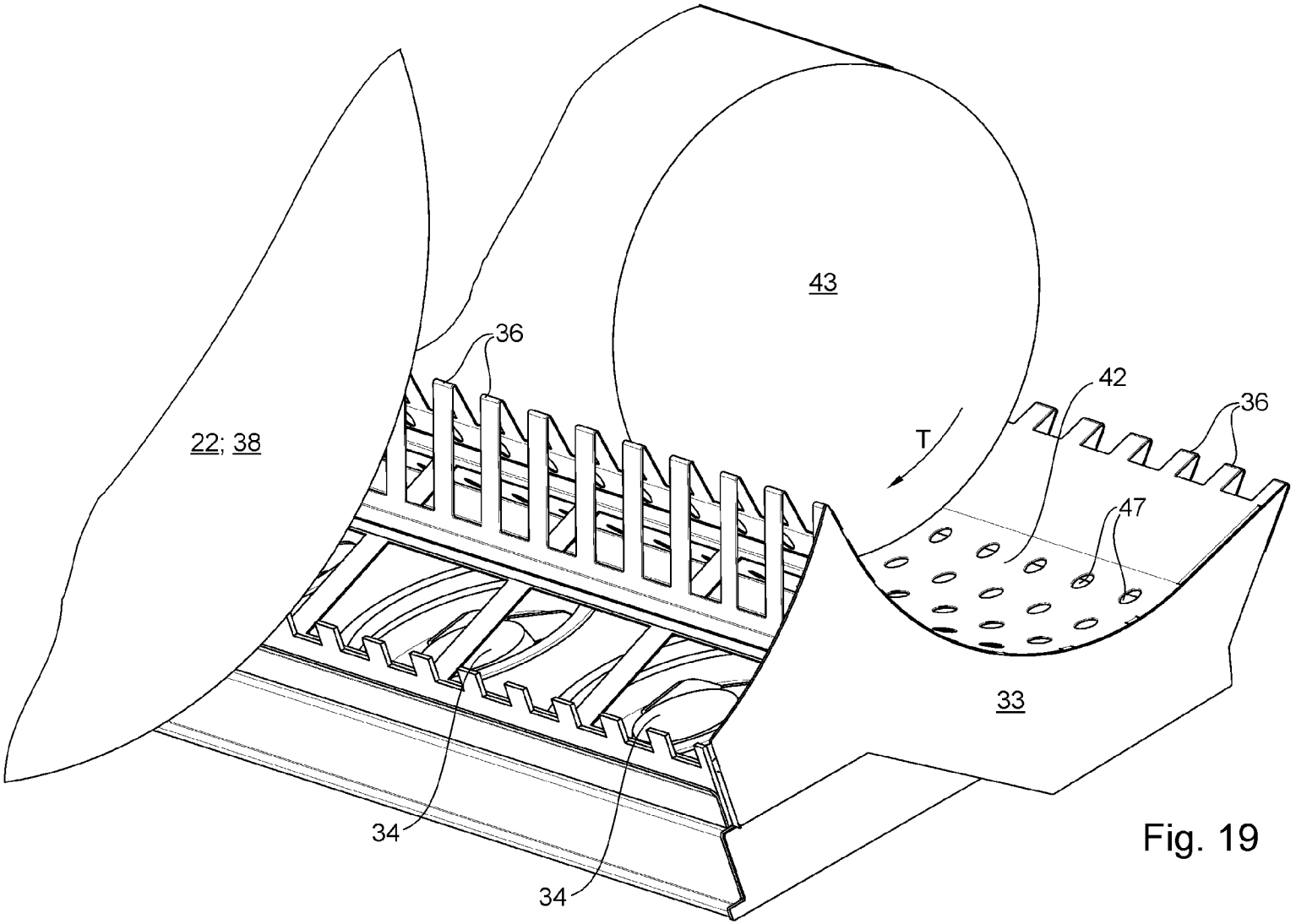
FIG. 19 shows a perspective view of a comb sucker with a guide plate.

A quadruple-sized printing cylinder 22; 38 has a diameter, e.g. of around 1,200 mm. A double-sized transfer drum 43 has a diameter, e.g. of around 600 mm. Below a transfer drum 43; 44 located upstream or downstream of the printing cylinder 22; 38, at least one comb sucker 33 which is equipped with a guide plate 42 is preferably provided (FIG. 19), wherein substrates transported by said transfer drum 43; 44 are transported passing along this guide plate 42 of comb sucker 33. Comb sucker 33 is an auxiliary device for supporting transported substrates, in which, rather than a substantially closed support surface for supporting the substrates to be transported, a guide plate 42 is provided, said guide plate 42 having a plurality of suction openings 47 arranged in a field-like manner, as is clear from FIG. 19, in particular in an area below the transfer drum 43; 44 in question, and said guide plate also including, in its preferably two opposing edge regions that extend in the circumferential direction of the transfer drum 43; 44 in question, a plurality of prongs 36 arranged parallel to one another in the direction of transport T of the substrates to be transported, said prongs 36 being in the form of teeth that comprise long and pointed extensions of the guide plate 42. Comb sucker 33 additionally has at least one suction device 34 with which substrates to be supported on the guide plate 42 are sucked toward said guide plate 42 by means of suction air generated by suction device 34 and flowing through the suction openings 47. If printing cylinder 22; 38 includes holding elements configured as grippers in each of its cylinder pits 62 for the purpose of holding substrates to be transported by said printing cylinder 22; 38, then the pressing element 28, configured, e.g. as a smoothing roller, is either spaced apart from the lateral surface of said printing cylinder 22; 38, i.e. forming a nip which can be adjusted to the thickness of the substrate, or the pressing element 28 is thrown onto the lateral surface of said printing cylinder 22; 38, pressing against said surface, but has undercuts to allow the passage of grippers. The e.g. compressible and/or elastic cylinder surfaces 29 of the transfer drum 43 located immediately upstream of printing cylinder 22; 38 are preferably also equipped with such undercuts for the passage of the grippers arranged on the lateral surface of printing cylinder 22; 38. As an alternative to the respective undercut, the grippers in question may be retracted in their respective cylinder pit 62 below the lateral surface of the relevant printing cylinder 22; 38. FIG. 14 shows printing cylinder 22; 38 with grippers for the leading and for the trailing end of each substrate to be held on the lateral surface of said printing cylinder 22; 38, with some grippers being depicted in their open operating position, in which they project radially beyond the lateral surface of said printing cylinder 22; 38, while others are shown in their closed operating position, in which they are closed in particular flush with the lateral surface of said printing cylinder 22; 38. The undercuts are necessary to prevent pressing element 28 from colliding with grippers that are in their open operating position.

Figure 15:
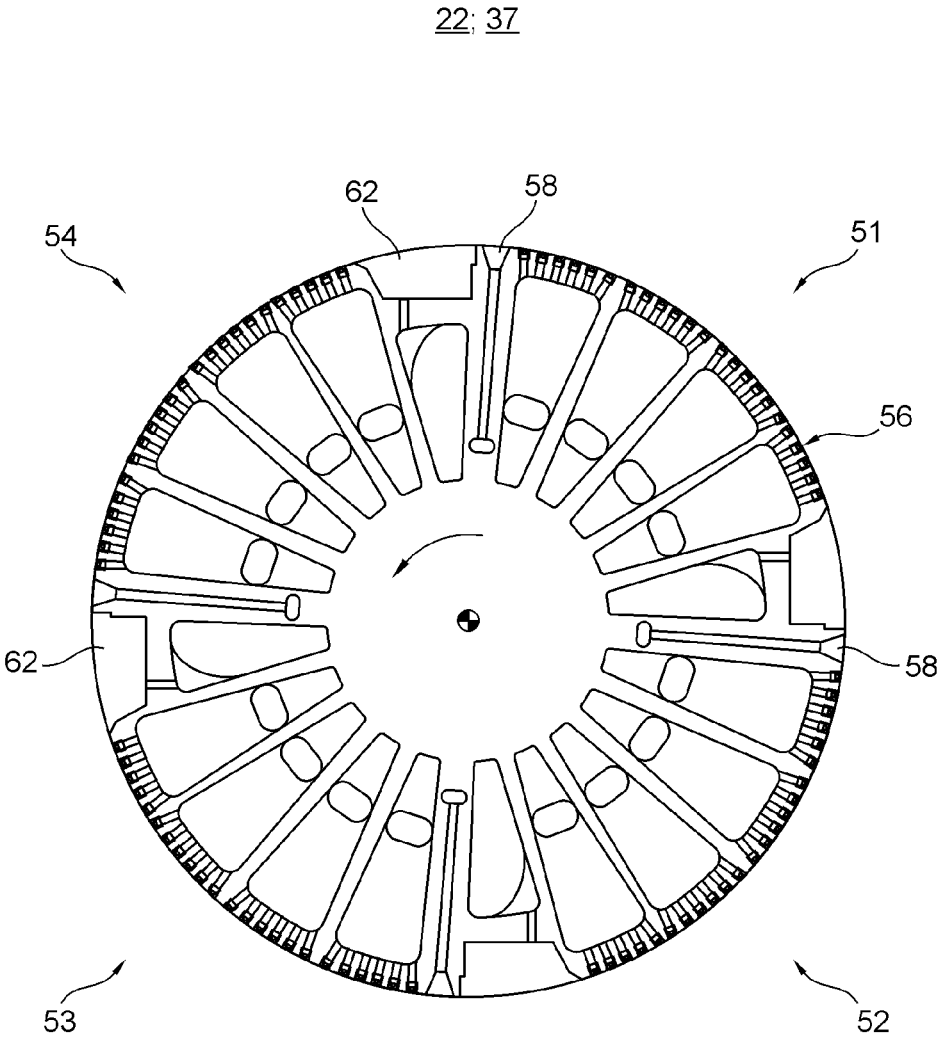
FIG. 15 shows a printing cylinder.

FIGS. 15 to 18 each show by way of example a configuration of the processing cylinder, in particular the printing cylinder 22; 38, as a suction cylinder, in particular as a flat suction cylinder. FIG. 15 shows a cross-sectional view of the suction cylinder. Printing cylinder 22; 38, which in this example is configured as a suction cylinder, is preferably quadruple-sized, meaning it has four fields 51; 52; 53; 54, one behind the other on its lateral surface in the circumferential direction, in each of which a substrate to be printed is or at least can be held, e.g. by suction air. For this purpose, multiple channels 56, each extending from the interior of said suction cylinder to its lateral surface, and in which channels a negative pressure as compared with the ambient air pressure is or at least can be generated by means of a suction device, end in each of the fields 51; 52; 53; 54 of said suction cylinder. These channels 56—also called suction bores—form a field of suction bores on the lateral surface of the suction cylinder in each respective field 51; 52; 53; 54. In each suction bore field, a substrate resting on the lateral surface of the suction cylinder is sucked and thus held against said cylinder over a large area. The size of the respective suction bore field is or at least can be adjusted, e.g. dependent upon the format of the substrate to be held.

Figure 16:
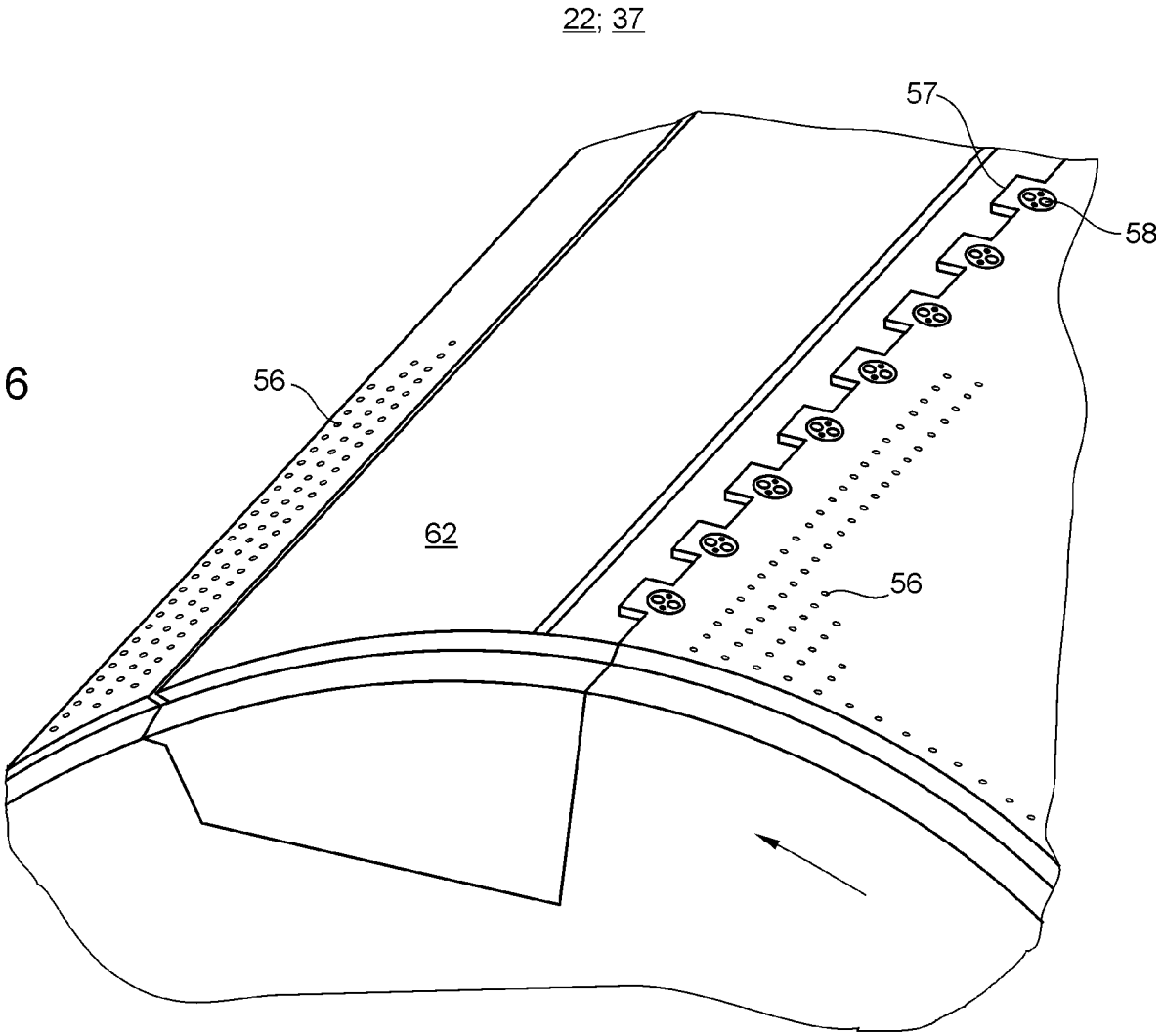
FIG. 16 shows a first perspective view of a section of the printing cylinder.

FIG. 16 shows a perspective detail enlargement of the suction cylinder of FIG. 15, in which the, e.g. matrix-type arrangement of the channels 56 ending at the lateral surface, i.e. the suction bore field, is indicated. At least or only at the leading end of each field 51; 52; 53; 54 in the direction of rotation of the suction cylinder, a row of teeth 57 is provided, and a holding means configured, e.g. as a sucker 58 is provided, in particular in conjunction with each of the respective teeth in the row of teeth 57, wherein the holding means configured as suckers 58 are preferably positioned in the area of the teeth in the row of teeth 57 and not in the area of the tooth gaps in said row of teeth 57. The suckers 58 provided in the area of the teeth in the row of teeth 57 are arranged, e.g. in a single row extending in the axial direction of the suction cylinder. The suckers 58 of the suction cylinder are supplied with suction air, e.g. shortly before a tangent point formed by this suction cylinder with a feed drum is reached. In another embodiment of the suction cylinder, grippers are provided at the leading end of each field 51; 52; 53; 54 in place of the suckers 58 there or in addition to said suckers 58. A gripper closure is formed by one of these grippers of the suction cylinder, e.g., at the tangent point formed by this suction cylinder with the smoothing roller, i.e. the gripper closure is created at this point in time or in this angular position of the suction cylinder. The direction of rotation of the suction cylinder is indicated by a directional arrow.

Figure 17:
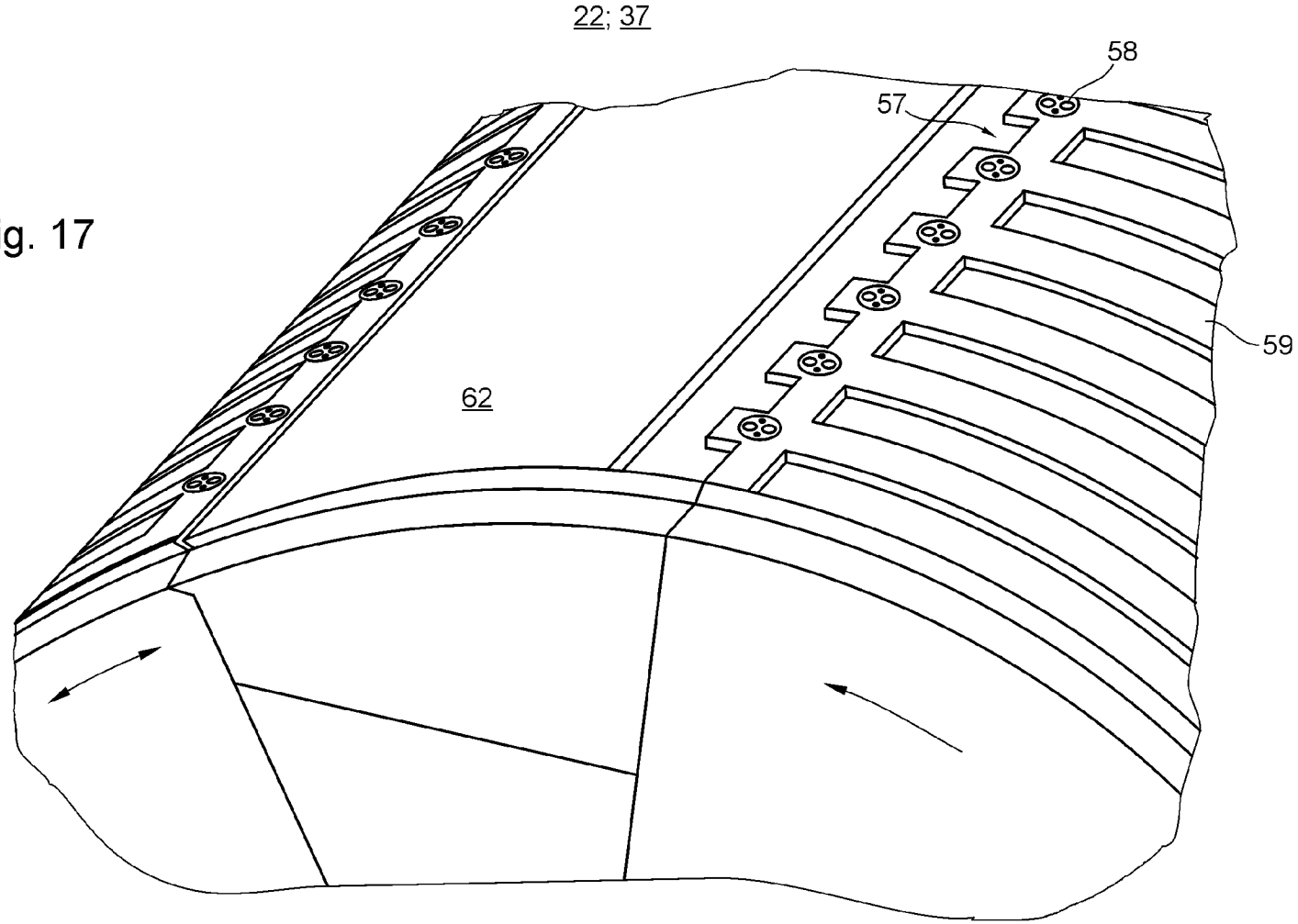
FIG. 17 shows a second perspective view of a section of the printing cylinder.

FIG. 17 shows a perspective detail enlargement of the suction cylinder illustrating a variant of the configuration of the lateral surface of the suction cylinder. In place of the lateral surface shown in FIG. 16 which has openings for channels 56 directed into the interior of the suction cylinder, in this case fixed strips 59 extending in the circumferential direction are formed, in particular in the fields 51; 52; 53; 54, on which fixed strips a suctioned substrate can rest, with such a substrate being held on the lateral surface of the suction cylinder by suction air acting between adjacent fixed strips 59. Either suction cylinder can be configured such that the trailing end of each field 51; 52; 53; 54 in the direction of rotation of the suction cylinder can be adapted in a variable format to the length of the substrate to be held on the lateral surface of the suction cylinder. This length-related adaptability of the respective length of each field 51; 52; 53; 54 in the circumferential direction of the suction cylinder is indicated by a double arrow in FIGS. 16 and 17. In a particularly advantageous configuration of the suction cylinder, grippers and/or suckers 58 are arranged at the leading end of each field 51; 52; 53; 54 in the direction of rotation of the suction cylinder, while suckers 58 are arranged at the trailing end of each field 51; 52; 53; 54 in the direction of rotation of the suction cylinder, wherein the angular position of the trailing end of a first field 51; 52; 53; 54 relative to the leading end of a second field 51; 52; 53; 54 immediately following the relevant first field 51; 52; 53; 54 in the direction of rotation of said suction cylinder is or at least can be variably adjusted, e.g. by a mechanical adjustment of parts of the lateral surface of the suction cylinder, based upon the format of the substrate to be held in the first field 51; 52; 53; 54, preferably even while said suction cylinder is rotating. It is further possible for the suction cylinder to be configured as flat in the region of its minimum format (FIG. 16) and to have fixed strips 59 in its variable-format region (FIG. 17).

Figure 18:
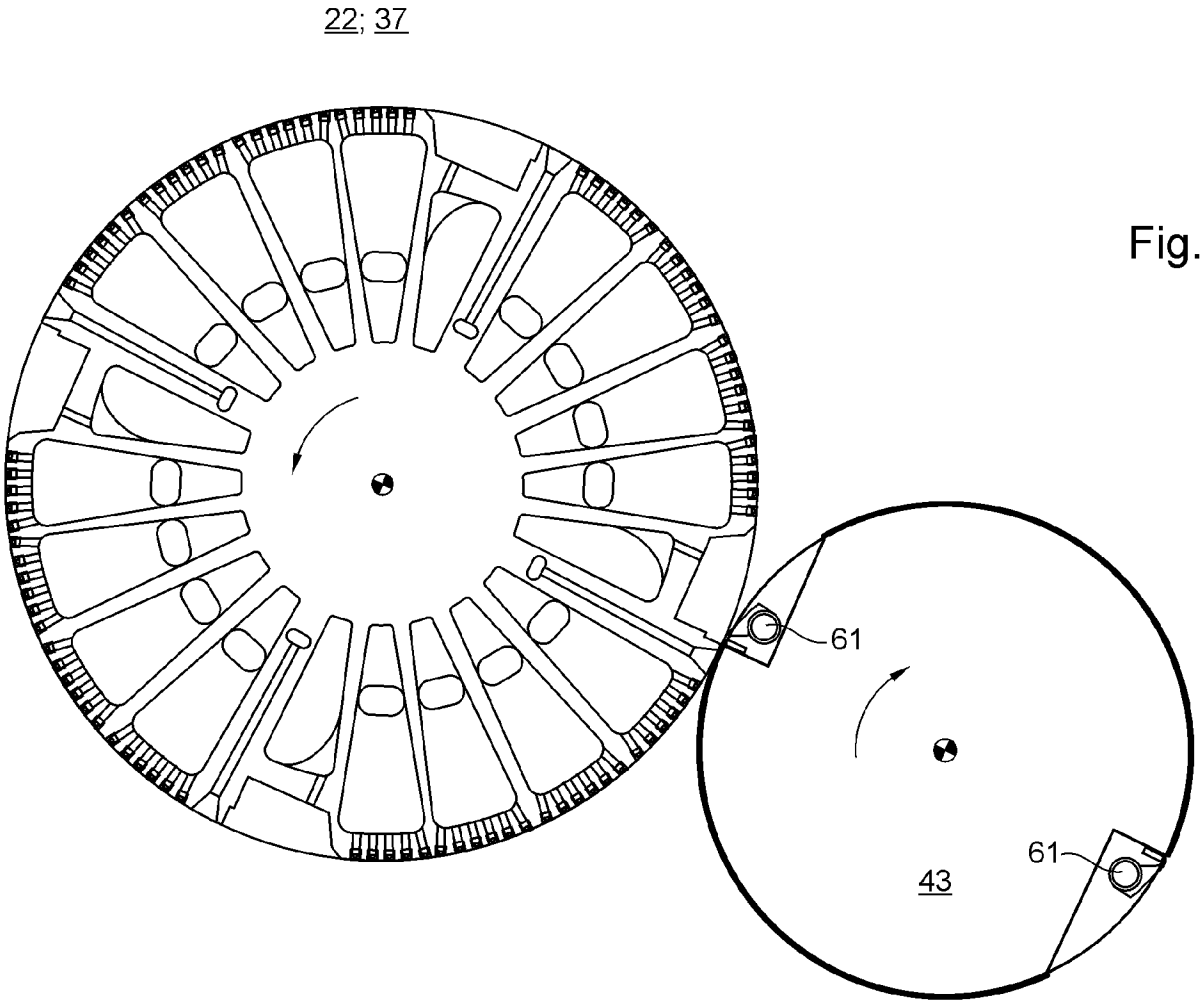
FIG. 18 shows the printing cylinder interacting with a transfer drum.

FIG. 18 shows a printing cylinder 22; 38 configured as a suction cylinder in cooperation with a transfer drum 43 configured as a feed cylinder, with said feed cylinder 43 being located immediately upstream of the suction cylinder. Feed cylinder 43 is preferably double-sized and is therefore able to accommodate two substrates one behind the other on its periphery. In another variant, feed cylinder 43 is triple-sized and is therefore able to accommodate three substrates one behind the other on its periphery. In a preferred variant, the ratio of the diameter of the printing cylinder 22; 38 to the diameter of the feed cylinder 43 immediately upstream of said printing cylinder 22; 38 is not an exact integer, rather the diameter of feed cylinder 43 is between 0.1% and 3% smaller than a whole number divisor of the diameter of printing cylinder 22; 38. For example, printing cylinder 22; 38 has a diameter of 1,200 mm and feed cylinder 43 has a diameter of only 598 mm rather than 600 mm, i.e. the diameter of the double-sized feed cylinder 43 is in a ratio of less than 1:2 to the quadruple-sized printing cylinder 22; 38 having a diameter of 1,200 mm. On its periphery, for example, i.e. on its lateral surface, feed cylinder 43 is equipped, e.g. with a flexible covering, with which it rolls along, i.e. is or at least can be thrown on for rolling, the peripheral surface of printing cylinder 22; 38, which is configured, in particular, as a suction cylinder. In one advantageous embodiment, transfer drum 43 has a slightly smaller diameter than, e.g. its double-sized configuration, so that the transfer drum 43, which is covered by a covering, does not apply any pressure against the lateral surface of printing cylinder 22; 38. Feed cylinder 43 holds each of the substrates, e.g. by means of grippers 61. If the suction cylinder is not free of channels, it also has at least one gripper, known as a safety gripper, e.g. in each of the axially extending channels 62 or cylinder pits 62 which are open to the lateral surface, and these grippers are capable of holding a substrate if the suction air is disrupted or fails. Both grippers for holding the leading end of the respective substrate and grippers for holding the trailing end of the respective substrate may be provided on the suction cylinder. These grippers of the suction cylinder engage, e.g., into the tooth gaps of the row of teeth 57 formed on the suction cylinder. FIG. 18 shows the angular position of the suction cylinder and feed cylinder 43 in which a substrate can be transferred from feed cylinder 43 to the suction cylinder. The respective cylinder pits 62 and grippers of feed cylinder 43 and suction cylinder are synchronized with one another in terms of their respective angular positions and operating positions for the purpose of transferring a substrate from feed cylinder 43 to the suction cylinder. The supply of suction air to the suction cylinder, i.e. to each of its suckers 58 and/or suction bore fields, is or at least can be switched on and off, e.g. dependent upon the angular position of the suction cylinder. Thus a substrate may be transferred from feed cylinder 43 to the suction cylinder solely by the activation of suckers 58, but also in conjunction with the grippers, both those of feed cylinder 43 and those of the suction cylinder. In a further configuration variant, it is provided for the feed cylinder 43 or the transfer drum to likewise be formed as a storage drum or as a suction drum, the features of which are comparable to those described above in reference to the printing cylinder 22; 38, so that each substrate is transferred already tautened from this storage drum or suction drum to the processing cylinder configured, in particular, as a suction cylinder, in particular printing cylinder 22; 38. Thus, each substrate is in its extended position even before it is transferred to the printing cylinder 22; 38, the extended position referring to the condition of the substrate in which its trailing edge is fixed true to register in relation to its leading edge. Alternatively, the extended position of the substrate is produced only when the substrate in question is situated on the lateral surface of the printing cylinder 22; 38. The latter embodiment presumes a reliable, precisely repeatable guidance of the substrate from feed cylinder 43 to printing cylinder 22; 38, whereas the former embodiment saves time and increases operational reliability, since the substrate is placed in its extended position while on the feed cylinder 43.

It is possible for a dryer 07; 09 to be positioned inside a feed cylinder 43 that cooperates with a printing cylinder 22; 38, which dryer is then used for drying substrates being transported by said feed cylinder 43, e.g. substrates that have been primed upstream. A dryer 07; 09 of this type dries a substrate e.g. by irradiating it with infrared or UV radiation and/or using hot air.

In the preferred embodiment of the respective machine arrangement, each of the non-impact printing units 06; 37 is configured as an inkjet printing unit. Inkjet printing units of this type each have at least one nozzle bar. At least one nozzle bar preferably extends orthogonally to the intended transport path of the printing substrate or substrate, over the working width of the printing machine. The at least one nozzle bar preferably has at least one row of nozzles. The at least one row of nozzles, as viewed in a transverse direction, preferably has nozzle openings, i.e. ink outlet openings, positioned at regular intervals, for example, over the entire working width of the printing machine and/or the width of the barrel surface of the at least one first central cylinder, i.e. printing cylinder 22; 38. The nozzles are preferably distributed over multiple print heads. The surface of the respective print head that surrounds the nozzle openings is preferably called the nozzle surface.

Each nozzle bar preferably has at least one supporting member. The print heads of this nozzle bar are mounted on the supporting member directly or preferably indirectly, for example via positioning means and/or via connecting elements configured in particular as alignment means. The nozzle bar itself is preferably disposed such that it is movable, via at least one adjustment device, relative to a frame of the printing assembly, i.e. the processing station 06 in question, and/or relative to the axis of rotation of a central cylinder of the printing assembly. In a first embodiment, the adjustment path of the adjustment device points exclusively in one adjustment direction which has at least one component in a direction radial to the axis of rotation of the central cylinder and which is more preferably oriented exclusively radially to the axis of rotation of the central cylinder. In a second embodiment of the adjustment device, at least 75%, more preferably at least 90% of the entire length the adjustment path of the adjustment device points in an adjustment direction, at least one component of which points in a direction parallel to the axis of rotation of the central cylinder and which more preferably is oriented exclusively parallel to the axis of rotation of the central cylinder. In that case, however, a small portion of the travel path will preferably point in a radial direction, in order to avoid damage to the print heads.

The adjusting movement executed by the adjustment device serves, for example, to make print heads accessible for maintenance and/or cleaning operations and/or for the replacement of one or more individual print heads or groups of print heads. In particular, adjusting movements executed by the adjustment device can be used to allow temporary access to respective print heads by a cleaning device.

Multiple print heads are preferably arranged side by side in the transverse direction on the at least one nozzle bar, with the nozzle surfaces of said print heads being rectangular in shape, for example, but more preferably in the shape of a trapezoid and/or a parallelogram. Since individual print heads of this type typically are not fitted with nozzles up to the edge of their housing, the print heads must be arranged overlapping one another in the transverse direction. The at least one row of nozzles is preferably configured not as a single linear row of nozzles, but as the sum of multiple individual rows of nozzles, more preferably two, which are offset from one another in the circumferential direction. Various embodiments of such nozzle rows are possible.

In a first embodiment, for example, at least two and more preferably precisely two rows of print heads extending in the transverse direction are arranged offset from one another in the circumferential direction of the first central cylinder, preferably such that print heads arranged in succession in the transverse direction preferably belong alternatingly to one of the at least two rows of print heads, preferably alternating constantly between a first and a second of two rows of print heads. Two such rows of print heads form a double row of print heads.

In a second embodiment, the shapes of the print head housings are configured as matched with one another. For example, one nozzle surface of each print head, and/or at least one surface of the print head that delimits the print head in its ejection direction, has a shape that deviates from rectangular, and in particular has the shape of a preferably symmetrical trapezoid and/or of a parallelogram. This enables the nozzle surfaces of adjacent print heads to overlap in the transverse direction even when the print heads are arranged immediately adjacent to one another in the transverse direction, in particular without being offset from one another in a direction of transport T. Such a row of print heads is called a diagonally overlapping row of print heads, for example.

In particular, multiple rows of print heads, for example at least four double rows and more preferably at least seven double rows of print heads, or preferably at least four rows of diagonally overlapping print heads and more preferably at least seven rows of diagonally overlapping print heads, are arranged one behind the other in the circumferential direction with respect to the at least one first central cylinder, at least during printing operation, said print heads being aligned toward the at least one first central cylinder.

One coating medium, in particular a printing ink of a certain color, for example one of the colors black, cyan, yellow, and magenta, or orange, green, or purple, or a finish coating, for example a clear finish coating, preferably is and/or can be assigned to each double row of print heads or to each diagonally overlapping row of print heads. For example, two double rows of print heads or two diagonally overlapping rows of print heads are assigned to each coating medium. The at least one print head works to generate droplets of coating medium, preferably by the drop-on-demand method, in which droplets of coating medium are generated selectively, as needed.

During regular printing operation, all print heads are arranged fixed in place. This serves to ensure the permanent alignment of all nozzles in register in terms of color register and/or feed register. Some situations exist in which, apart from the movement by means of the adjustment device, a defined aligning movement of the print heads may be necessary. Said aligning movement of the print heads is preferably carried out by means of at least one positioning device.

At least one positioning device is preferably provided, which can be used to adjust the position of at least one print head, in particular the position of said print head relative to other print heads of the printing assembly and/or to other print heads belonging to the same nozzle bar, and/or the position of said print head with respect to the transverse direction and/or the position of said print head with respect to a pivot axis oriented parallel to its nozzle ejection direction. Preferably, multiple positioning devices are provided. For example, each print head may be assigned its own positioning device. Preferably, however, at least one such positioning device is assigned to multiple print heads collectively, in particular such that the positions of multiple print heads can be adjusted collectively by means of the common positioning device assigned to them, in particular in terms of their position relative to the common nozzle bar and/or relative to other print heads that are arranged on said common nozzle bar and/or in terms of their position with respect to the transverse direction and/or in terms of their position with respect to a pivot axis which is oriented parallel to their nozzle ejection direction.

The at least one positioning device has at least one base body, for example. The at least one print head is preferably located on the at least one base body. More preferably, multiple print heads, in particular at least three and preferably at least four print heads, are arranged on the at least one base body. The base body is preferably formed as a single integral unit.

Each respective print head is connected on one side to the base body and on the other side via at least one connecting element, for example. The at least one connecting element is configured, for example, as an alignment device. The alignment device can be used to align the respective print head, preferably individually, relative to the base body, in particular manually and/or in terms of the position of said print head with respect to the transverse direction and/or in terms of its position with respect to a pivot axis which is oriented parallel to the nozzle ejection direction of said print head. This enables preferably multiple print heads, in particular at least three and more preferably at least four print heads, to be aligned relative to the base body and thus also relative to one another.

These multiple print heads, in particular at least three and more preferably at least four print heads, and the base body preferably each represent a component of a first assembly unit. The print heads of the first assembly unit are aligned outside of the printing assembly relative to the base body and thus relative to one another, for example. This means that they can be aligned relative to the base body and thus also relative to one another using the appropriate tool and/or with the aid of a camera that records their relative positions and/or with particularly good accessibility. A first assembly unit which is aligned with particular precision is thereby produced.

The respective nozzle bar is preferably arranged supporting multiple such first assembly units. Each of these multiple first assembly units can preferably be adjusted in terms of its position relative to the supporting body of said nozzle bar by means of its own positioning device. Multiple positioning devices are therefore preferably arranged on one supporting body. Preferably, multiple first assembly units are arranged, at least indirectly via the positioning devices, on one supporting body, each assembly unit being adjustable in terms of its position relative to the supporting body, in particular by means of the multiple positioning devices. The print heads of two diagonally overlapping rows of print heads are arranged, at least indirectly via the positioning devices, on one supporting body, for example.

By moving the supporting body, all the print heads attached directly or indirectly thereto can then be moved, in particular without altering their alignment relative to one another.

To determine which print head or which group of print heads needs to be moved to what extent and in which direction in order to produce the optimum print result, at least one test print image is preferably printed and inspected. The result is used to determine settings for positioning devices, which are then adjusted manually and/or by means of respective positioning drives. The settings of the individual alignment devices are preferably determined and/or adjusted manually but may alternatively likewise be determined via at least one test print image.

Preferably, at least one sensor configured as a first printed image sensor is provided, in particular at a point along the transport path of the printing substrate downstream of the first printing unit. The at least one first printed image sensor is embodied, for example, as a first line camera or as a first surface camera. The at least one first printed image sensor is embodied, for example, as at least one CCD sensor and/or as at least one CMOS sensor. This at least one first printed image sensor and a corresponding evaluation unit, for example the superordinate machine controller, are preferably used for monitoring and/or regulating the actuation of all the print heads and/or double rows of print heads and/or diagonally overlapping rows of print heads positioned and/or acting one behind the other in the circumferential direction of the at least one first central cylinder of the first printing unit. In a first embodiment of the at least one printed image sensor, only a first printed image sensor is provided, the sensor field of which covers the entire width of the transport path of the printing substrate. In a second embodiment of the at least one printed image sensor, only a first printed image sensor is provided, which is configured as movable in the transverse direction. In a third embodiment of the at least one printed image sensor, multiple printed image sensors are provided, the respective sensor fields of which each cover a different region of the transport path of the printing substrate with respect to the transverse direction.

The positioning of pixels formed by droplets of coating medium, each originating from a respective first print head, is preferably compared with the positioning of pixels formed by droplets of coating medium, each originating from a respective second print head located downstream of the respective first print head in the circumferential direction of the at least one first central cylinder and/or in the designated direction of transport T of the printing substrate, and/or arranged in the direction transversely to the print head. This is preferably carried out regardless of whether these first and second print heads positioned and/or acting one behind the other in the circumferential direction of the at least one first central cylinder are processing the same or a different coating medium. The correlation of the positions of the printed images produced by different print heads is preferably monitored. If the same coating media are being used, the register-true merging of partial images is monitored. If different coating media are being used, the feed register or the color register is monitored. Quality control of the printed image is also preferably carried out based upon the measured values of the at least one printed image sensor.

At least one adjustment sensor is preferably provided. More preferably, at least two adjustment sensors are provided. The at least one adjustment sensor, and more particularly the at least two adjustment sensors, serve(s) to collect data regarding the adjustments of multiple print heads or groups of print heads, for example at least four, relative to one another. The at least one adjustment sensor or the at least two adjustment sensors is/are preferably optical sensors. Such relative adjustments are, for example, relative geometric positions of the print heads or groups of print heads and/or relative actuation times, in particular droplet ejection times of the print heads and/or groups of print heads. The relative adjustments are additionally or alternatively relative adjustments, for example, that affect at least one ink density and/or at least one area coverage and/or at least one point size of generated pixels. In the following, the relative adjustment is referred to geometric positioning and/or actuation times, in particular droplet ejection times. However, the described devices and/or processes also apply to the other relative adjustments mentioned, provided no contradictions arise therefrom.

The at least one adjustment sensor and in particular the at least two adjustment sensors are preferably configured at least as position sensors. The at least two adjustment sensors, in particular position sensors, are configured, for example, as cameras and/or CCD sensors and/or CMOS sensors. The at least two adjustment sensors, in particular position sensors, are preferably used to directly or indirectly detect the position and/or actuation of each of at least two print heads and/or groups of print heads relative to one another. For indirect detection, which is preferred, the at least one adjustment sensor, in particular the at least two adjustment sensors, preferably is/are arranged aligned and/or alignable toward the printing substrate and/or is/are arranged aligned and/or alignable toward the transport path provided for the transport of printing substrate, and/or is/are arranged aligned and/or alignable toward at least one transfer body.

The position of the target region of at least one newly positioned and/or repositioned print head relative to the position of the target region of at least one previously positioned print head and/or the position of the target region of at least one newly positioned and/or repositioned group of print heads relative to the position of the target region of at least one previously positioned group of print heads is preferably at least temporarily detectable. This is preferably accomplished by comparing the relative positions of pixels produced by the respective print heads on the printing substrate using a common adjustment sensor, in particular a position sensor. These relative positions of the pixels are preferably evaluated by means of an evaluation unit, for example the higher-level machine controller.

As at least one adjustment sensor, the above-described at least one first printed image sensor is used, for example. Preferably, however, adjustment sensors other than the above-described at least one first printed image sensor are used, for example adjustment sensors configured specifically for this task.

Following the installation and/or maintenance and/or replacement and/or cleaning of at least one print head and/or at least one group of print heads, a test print is preferably run to produce at least one printed test image, in which the print head to be newly positioned and/or repositioned and/or the group of print heads to be newly positioned and/or repositioned, and at least one print head serving as a reference or guiding print head transfer printing ink droplets or ink droplets onto the printing material or substrate. The at least one test print is preferably detected automatically by at least one adjustment sensor, for example the first printed image sensor. If a deviation of the actual position of the at least one newly positioned and/or repositioned print head or of the corresponding group of print heads from a target position is documented and detected based upon the at least one printed test image, the position of said print head or said group of print heads in the transverse direction and/or with respect to a pivot position is preferably adjusted automatically by means of the corresponding positioning device, and/or the actuation of the nozzles of said print head is preferably adjusted automatically with respect to the actuation time, in particular the droplet ejection time.

While preferred embodiments of a machine arrangement with printing unit for the sequential processing of sheet-type substrates, in accordance with the present invention, have been set forth fully and completely herein above, and will be apparent to one of skill in the art that various changes could be made thereto without departing from the true spirit and scope of the present invention which is accordingly to be limited only by the appended claims.

The invention claimed is:

1. A machine arrangement for the sequential processing of sheet-type substrates having multiple different processing stations (01; 02; 03; 04; 06; 07; 08; 09; 11; 12), wherein two of the processing stations (01; 02; 03; 04; 06; 07; 08; 09; 11; 12) each have at least one non-impact printing unit (06; 37) for printing each of the substrates, wherein the relevant processing station that has the at least one non-impact printing unit (06; 37) has a printing cylinder (22; 38), wherein the respective non-impact printing unit (06; 37) is arranged on the periphery of the printing cylinder (22; 38) in each case, wherein each respective printing cylinder (22; 38) is configured as triple-sized or quadruple-sized, wherein each respective printing cylinder (22; 38) is configured as a suction cylinder, wherein the supply of suction air to the relevant printing cylinder (22; 38) is or at least can be switched on and off in each case dependent upon the angular position of said printing cylinder (22; 38), wherein each respective printing cylinder (22; 38) has multiple fields (51; 52; 53; 54) arranged one behind the other in the circumferential direction on its lateral surface, each for holding one substrate in each case, wherein a dryer (09) is located downstream of the first non-impact printing unit (06) in the direction of transport (T) of the substrates, wherein downstream of this dryer (09) in the direction of transport (T) of the substrates, a turning device (23) is provided, which enables the reverse side of the substrates to also be printed as the process progresses, wherein said turning device (23) is arranged between the processing station having the first non-impact printing unit (06) and the processing station having the second non-impact printing unit (37), in the direction of transport (T) of the substrates.

2. The machine arrangement according to claim 1, characterized in that a double-sized or triple-sized transfer drum (43) or a corresponding feed cylinder (43) is located immediately upstream of the respective printing cylinder (22; 38) in each case, and/or in that a double-sized or triple-sized transfer drum (44) or a corresponding transport cylinder (44) is located immediately downstream of said printing cylinder.

3. The machine arrangement according to claim 2, characterized in that the transfer drum (43) located immediately upstream of each respective printing cylinder (22; 38), or the feed cylinder (43) located immediately upstream in each case has multiple cylinder surfaces (29) that are adjustable in the circumferential direction, wherein the cylinder surfaces (29) of the transfer drum (43) located immediately upstream of the respective printing cylinder (22; 38) in each case or of the immediately upstream feed cylinder (43) are each mounted such that their position is adjustable.

4. The machine arrangement according to claim 2, characterized in that the double-sized or triple-sized transfer drum (43; 44) or the corresponding feed cylinder (43) or the corresponding transport cylinder (44) are configured such that they can accommodate two or three substrates one behind the other on their respective periphery.

5. The machine arrangement according to claim 1, characterized in that at the leading end of each field (51; 52; 53; 54) in the direction of rotation of the respective suction cylinder, grippers and/or suckers (58) are arranged in each case, and at the trailing end of each field (51; 52; 53; 54) in the direction of rotation of the respective suction cylinder, suckers (58) are arranged in each case.

6. The machine arrangement according to claim 1, characterized in that with respect to the relevant printing cylinder (22; 38), the angular position of the trailing end of a first field (51; 52; 53; 54) relative to the leading end of a second field (51; 52; 53; 54) that immediately follows said first field (51; 52; 53; 54) in the direction of rotation of said printing cylinder (22; 38) is variably adjustable based upon the format of the substrate to be held in the first field (51; 52; 53; 54).

7. The machine arrangement according to claim 1, characterized in that multiple channels (56), each terminating in one of the fields (51; 52; 53; 54), form a suction bore field in the respective field (51; 52; 53; 54) on the lateral surface of the relevant printing cylinder (22; 38), wherein the size of the respective suction bore field is or at least can be adjusted based upon the format of the substrate to be held.

8. The machine arrangement according to claim 1, characterized in that in the fields (51; 52; 53; 54), fixed strips (59) extending in the circumferential direction are formed, on which a suctioned substrate can rest, wherein such a substrate is held on the lateral surface of the relevant suction cylinder by suction air acting between adjacent fixed strips (59).

9. The machine arrangement according to claim 1, characterized in that at least or only at the leading end of each field (51; 52; 53; 54) in the direction of rotation of each respective printing cylinder (22; 38), a row of teeth (57) is provided, containing multiple teeth arranged adjacent to and spaced apart from one another in the axial direction of the respective printing cylinder (22; 38), wherein each tooth in the row of teeth (57) has at least one sucker (58).

10. The machine arrangement according to claim 1, characterized in that a straight line that runs through the rotational axis of the printing cylinder (22; 38) and through the rotational axis of the transfer drum (44) located immediately downstream or through the rotational axis of the transport cylinder (44) located immediately downstream forms an acute angle ($\alpha$1) to a horizontal line, and/or in that a straight line that runs through the rotational axis of the printing cylinder (22; 38) and through the rotational axis of the transfer drum (43) located immediately upstream or through the rotational axis of the feed cylinder (43) located immediately upstream forms an acute angle ($\alpha$2) to a horizontal line, wherein in each case the horizontal line runs through the rotational axis of the relevant transfer drum (43; 44) or through the rotational axis of the relevant transport cylinder (44) or the rotational axis of the relevant feed cylinder (43).

11. The machine arrangement according to claim 10, characterized in that the angle ($\alpha$1) directed toward the transfer drum (44) downstream or toward the transport cylinder (44) downstream measures between one and two times the angle ($\alpha$2) directed toward the transfer drum (43) upstream or toward the feed cylinder (43) upstream, or between 1.3 times and 1.7 times the angle ($\alpha$2) directed toward the transfer drum (43) upstream or toward the feed cylinder (43) upstream, or amounts to 1.5 times the angle ($\alpha$2) directed toward the transfer drum (43) upstream or toward the feed cylinder (43) upstream, and/or in that the angle ($\alpha$2) directed toward the transfer drum (43) upstream or toward the feed cylinder (43) upstream measures between 15° and 30° or between 20° and 25°, or measures 22.5°.

12. The machine arrangement according to claim 1, characterized in that the respective triple-sized or quadruple-sized printing cylinder (22; 38) has at least enough holding elements on its periphery that three or four substrates are or at least can be arranged one behind the other on its periphery, each held in place in a force-fitting and/or in a form-fitting manner.

13. The machine arrangement according to claim 1, characterized in that with respect to the respective suction cylinder, the angular position of the trailing end of a first field (51; 52; 53; 54) relative to the leading end of the second field (51; 52; 53; 54), which immediately follows said first field (51; 52; 53; 54) in the direction of rotation of the relevant suction cylinder, is or at least can be variably adjusted by a mechanical displacement of parts of the lateral surface of the relevant suction cylinder, based upon the format of the substrate to be held in the first field (51; 52; 53; 54).

14. The machine arrangement according to claim 1, characterized in that in the region of a minimum format of the relevant substrate to be held, the respective suction cylinder is formed by a suction bore field, having openings for channels (56) that are directed into the interior of the suction cylinder, and in its variable-format region said suction cylinder has fixed strips (59).

15. The machine arrangement according to claim 1, characterized in that a first primer application unit (02) followed by a first dryer (07) are arranged upstream of the first non-impact printing unit (06) in the direction of transport (T) of the substrates.

16. The machine arrangement according to claim 1, characterized in that the substrates coming from the turning device (23) are fed first to a second primer application unit (02) for treating the reverse side of the substrates, and afterward to a further dryer (07), followed only thereafter by the second non-impact printing unit (37) with its printing cylinder (38) for printing the reverse side of each of the substrates.

17. The machine arrangement according to claim 1, characterized in that the dryer (70; 09) in question is configured as a hot air dryer and/or as a UV dryer or as an IR dryer or as a microwave dryer.

18. The machine arrangement according to claim 17, characterized in that the respective UV dryer or IR dryer is configured in each case as an LED dryer.

* * * * *